US012487045B2

(12) United States Patent
Sims

(10) Patent No.: US 12,487,045 B2
(45) Date of Patent: Dec. 2, 2025

(54) FIREARM SUPPRESSOR

(71) Applicant: Chad Brandon Sims, Locust Grove, GA (US)

(72) Inventor: Chad Brandon Sims, Locust Grove, GA (US)

(73) Assignee: Argos Ordnance, Inc., Locust Grove, GA (US)

( * ) Notice: Subject to any disclaimer, the term of this patent is extended or adjusted under 35 U.S.C. 154(b) by 0 days.

(21) Appl. No.: 18/388,970

(22) Filed: Nov. 13, 2023

(65) Prior Publication Data

US 2024/0159488 A1 May 16, 2024

Related U.S. Application Data

(60) Provisional application No. 63/425,565, filed on Nov. 15, 2022.

(51) Int. Cl.
*F41A 21/30* (2006.01)

(52) U.S. Cl.
CPC ..... *F41A 21/30* (2013.01)

(58) Field of Classification Search
CPC ..... F41A 21/30–38
USPC ..... 89/14.2–14.4; 181/223
See application file for complete search history.

(56) References Cited

U.S. PATENT DOCUMENTS 3,667,570 A * 6/1972 WerBell, III ..... F41A 21/30 89/14.4
6,308,609 B1 * 10/2001 Davies ..... F41A 21/30 89/14.4
6,374,718 B1 4/2002 Rescigno et al.
6,575,074 B1 6/2003 Gaddini
7,789,009 B1 * 9/2010 Brittingham ..... F41A 21/325 89/14.3
8,875,612 B1 * 11/2014 Klett ..... F41A 21/34 89/14.4
8,950,310 B2 * 2/2015 Storrs ..... F01N 3/02 89/14.1
8,950,546 B2 2/2015 Shults et al.
9,097,482 B1 * 8/2015 Holden ..... F41A 21/30
D742,987 S 11/2015 Holden et al.
D742,989 S 11/2015 Holden et al.
9,328,984 B2 5/2016 Shults et al.
9,347,727 B1 * 5/2016 Cler ..... F41A 21/30
9,500,427 B1 * 11/2016 Larue ..... F41A 21/30
9,677,839 B1 * 6/2017 Phoenix ..... F41A 21/30
10,228,210 B2 * 3/2019 Parker ..... F41A 21/30
10,393,463 B1 * 8/2019 Sanders ..... F41A 21/34
10,753,699 B2 * 8/2020 Klett ..... F41A 21/30
10,976,125 B2 4/2021 Hood, II et al.
11,162,753 B2 * 11/2021 Kras ..... F41A 21/34
(Continued)

*Primary Examiner* — Troy Chambers
*Assistant Examiner* — Benjamin S Gomberg

(57) ABSTRACT

A suppressor assembly for a firearm includes a rear mount, a rear cap, at least one baffle on a forward side of the rear cap, and a front cap on a forward side of the at least one baffle. The rear mount includes an inner bore, a rear attachment interface, and a forward attachment interface. The rear cap is attached to the rear mount through the forward attachment interface. The rear attachment interface connects the suppressor assembly to the firearm. The front cap includes a plurality of exit holes that allow propellant gases to exit the suppressor assembly through the front cap.

18 Claims, 16 Drawing Sheets

(56) References Cited

U.S. PATENT DOCUMENTS

| | | | | |
|---|---|---|---|---|
| 11,506,463 | B1 * | 11/2022 | Kunsky | F41A 21/30 |
| 12,044,495 | B2 * | 7/2024 | Johansen | F41A 21/30 |
| 2013/0319790 | A1 * | 12/2013 | Bladen | F41A 21/30 181/223 |
| 2017/0299313 | A1 * | 10/2017 | Adamson, Jr. | F41A 21/30 |
| 2017/0350670 | A1 | 12/2017 | Grob | |
| 2020/0025494 | A1 * | 1/2020 | Parker | F41A 21/30 |
| 2020/0141679 | A1 * | 5/2020 | Garst | F41A 21/30 |
| 2020/0173751 | A1 * | 6/2020 | Dorne | F41A 21/30 |
| 2020/0182578 | A1 | 6/2020 | Turnblom | |
| 2020/0232741 | A1 * | 7/2020 | Hood, II | F41A 21/30 |
| 2021/0041200 | A1 * | 2/2021 | Kras | F41A 21/30 |
| 2022/0049920 | A1 * | 2/2022 | Kras | F41A 21/30 |
| 2022/0260332 | A1 * | 8/2022 | Grob | F41A 21/30 |
| 2022/0404111 | A1 * | 12/2022 | Hodowanec | F41A 21/30 |

* cited by examiner

FIREARM SUPPRESSOR

CROSS REFERENCE TO RELATED APPLICATION

This application is related to and claims priority benefit from U.S. Provisional Application No. 63/425,565 ("the '565 application"), filed on Nov. 15, 2022. The '565 application is hereby incorporated in its entirety by this reference.

FIELD OF THE INVENTION

The field of the invention relates to firearm suppressors, particularly modular suppressors for firearms designed as a flow-through system.

BACKGROUND

Firearm suppressors, often referred to as silencers or moderators, are designed to change and/or dissipate energy that ultimately exits the firearm after a round is fired. For an unsuppressed firearm, when the projectile exits the barrel, propellant gases follow the projectile out of the barrel such that the gases are significantly hotter than the environment outside the barrel (i.e., the gases in the air near the muzzle) and have a much higher pressure and velocity than the environment. In most cases, a suppressor introduces a new or additional space for these propellant gases. This space is a chamber or chambers that dissipate energy by: (i) creating a larger volume for the propellant gases to expand before exiting the firearm; (ii) causing the propellant gases to expel energy via turbulent flow before exiting the suppressor; and (iii) absorbing some of the heat from the propellant gases. It should be noted that the increase in volume and dissipation of energy through turbulence also contribute to reducing the temperature of the gases that ultimately exit the suppressor. Accordingly, the propellant gases that exit the suppressor are cooler and have a lower velocity compared to propellant gases exiting an unsuppressed firearm. The practical results of a suppressor are: (i) reduction (not elimination) of sound when a round is fired; (ii) reduction (not elimination) of visible light when the projectile exits (often referred to as muzzle flash); and (iii) heat transferred into the suppressor.

To increase the effectiveness of suppressors, heat management, and manufacturability, it may be desirable to design new suppressor assemblies.

SUMMARY

The terms "invention," "the invention," "this invention" and "the present invention" used in this patent are intended to refer broadly to all of the subject matter of this patent and the patent claims below. Statements containing these terms should be understood not to limit the subject matter described herein or to limit the meaning or scope of the patent claims below. Embodiments of the invention covered by this patent are defined by the claims below, not this summary. This summary is a high-level overview of various aspects of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this patent, any or all drawings and each claim.

According to certain embodiments of the present invention, a suppressor assembly for a firearm comprises: a rear mount comprising an inner bore, a rear attachment interface, and a forward attachment interface; a rear cap attached to the rear mount through the forward attachment interface; at least one baffle on a forward side of the rear cap; and a front cap on a forward side of the at least one baffle, wherein: the rear attachment interface connects the suppressor assembly to the firearm; and the front cap comprises a plurality of exit holes that allow propellant gases to exit the suppressor assembly through the front cap.

DETAILED DESCRIPTION

The subject matter of embodiments of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described.

The illustrated embodiments shown in FIGS. 1-9 illustrate components of firearm suppressor assemblies capable of being attached to the muzzle of a firearm. The features, concepts, and functions described herein are also applicable (with potential necessary alterations for particular applications) to integrally suppressed barrels for handguns, rifles, carbines, shotguns, or any other type of firearm. Furthermore, the embodiments may be compatible with various calibers including rifle calibers such as, for example, 5.56×45 mm NATO, .223 Remington, 7.62×51 mm NATO, .308 Winchester, 7.62×39 mm, 5.45×39 mm; pistol calibers such as, for example, 9×19 mm, .45 ACP, .40 S&W, .380 ACP, 10 mm Auto, 5.7×28 mm; and shotgun calibers such as, for example, 12 gauge, 20 gauge, 28 gauge, .410 gauge, 10 gauge, 16 gauge. The illustrated embodiments focus on components of shotguns; however, the concepts and features described herein can be are also applicable (with potential necessary alterations for particular applications) to other firearm platforms, including the AR-15 style firearms, handguns, pistols, rifles, and any other relevant firearms.

Many conventional suppressors include a fixed volume or sealed configuration to simply trap expanding gasses to reduce sound pressure levels. However, for certain calibers or configurations, there are advantages associated with suppressors that are not sealed and include design elements to allow expanding gasses to flow through and escape (e.g., through the front cap assembly). For example, non-sealed suppressors may can limit back pressure to (i) reduce gases expelled toward the operator's face and/or (ii) increase the reliability and predictability of the firearm's operating system. Non-sealed suppressors allow for multiple baffle configurations as well as user serviceability. The illustrated embodiments include some examples of flow-through and non-sealed suppressors but are not limited thereto.

Figure 1:
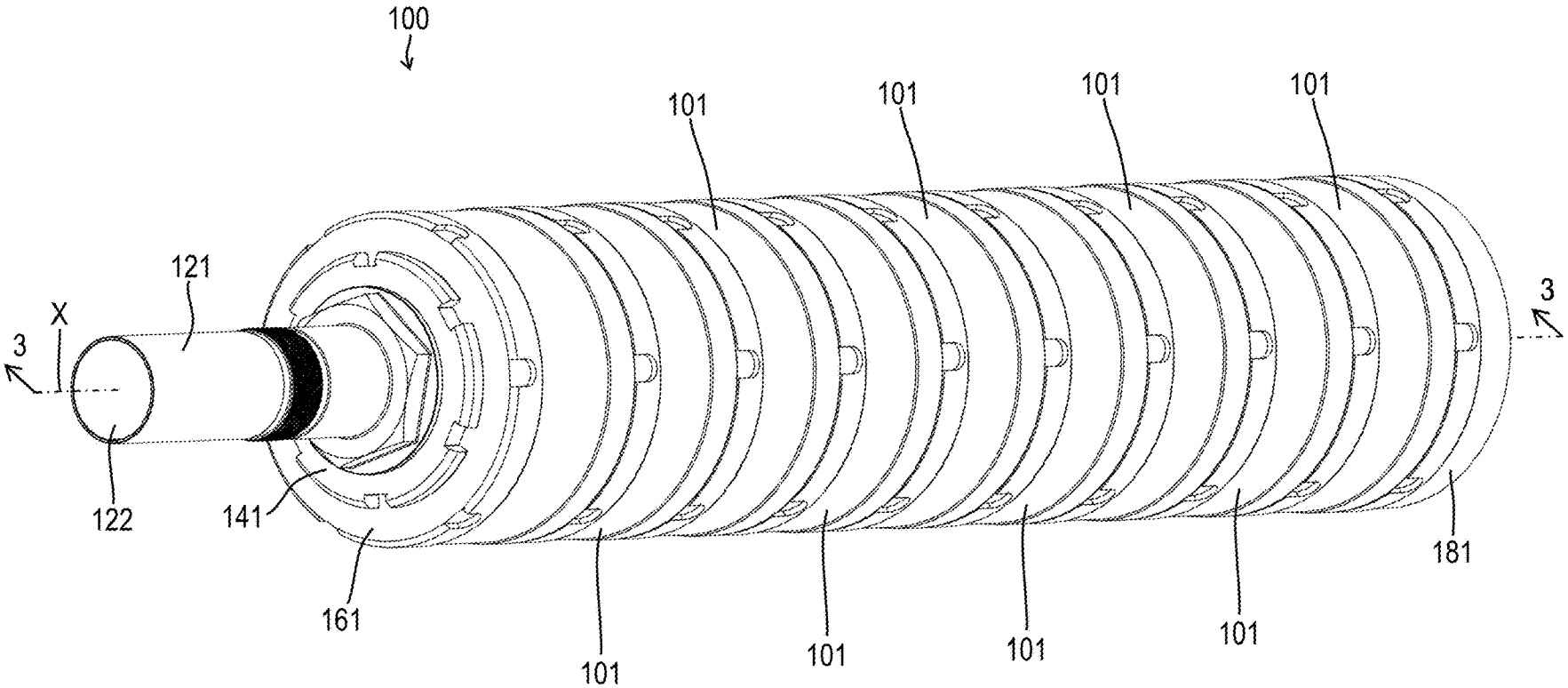
FIG. 1 is a rear perspective view of a firearm suppressor assembly according to certain embodiments of the present invention.
Figure 2:
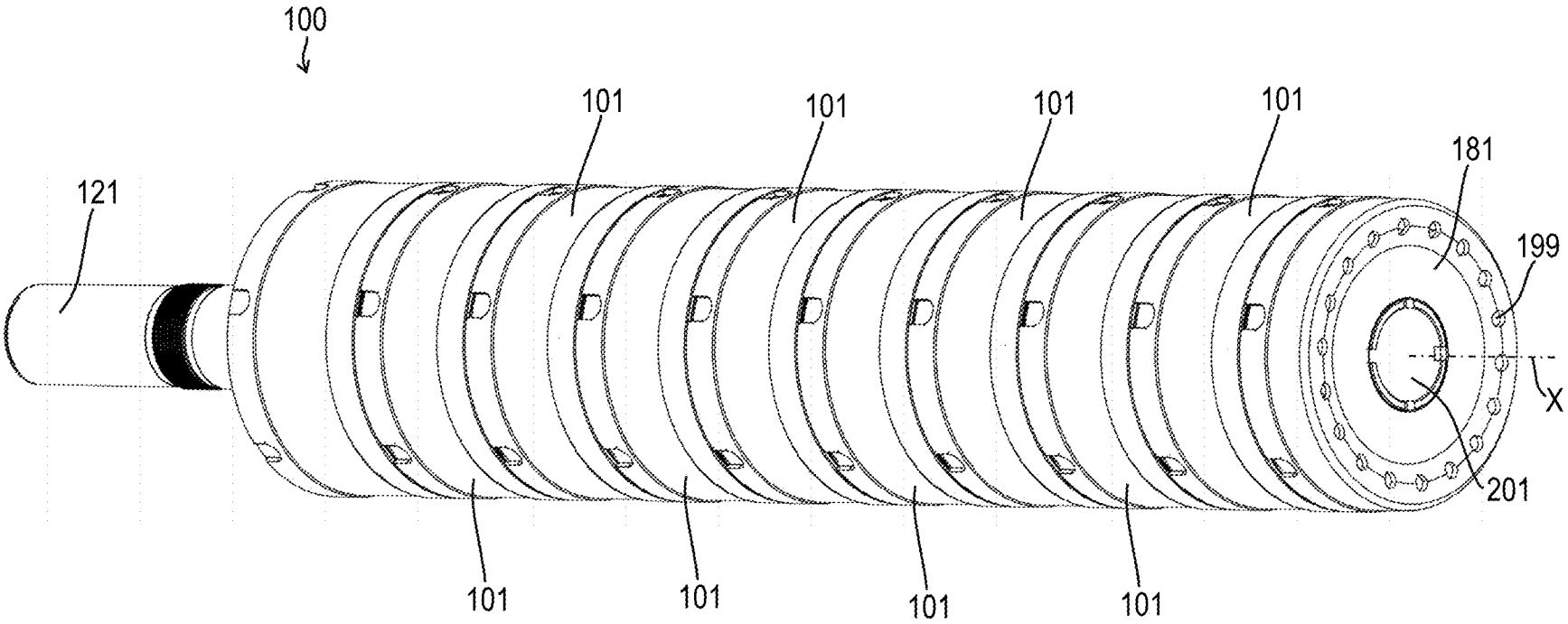
FIG. 2 is a front perspective view of the firearm suppressor assembly of FIG. 1.
Figure 3:
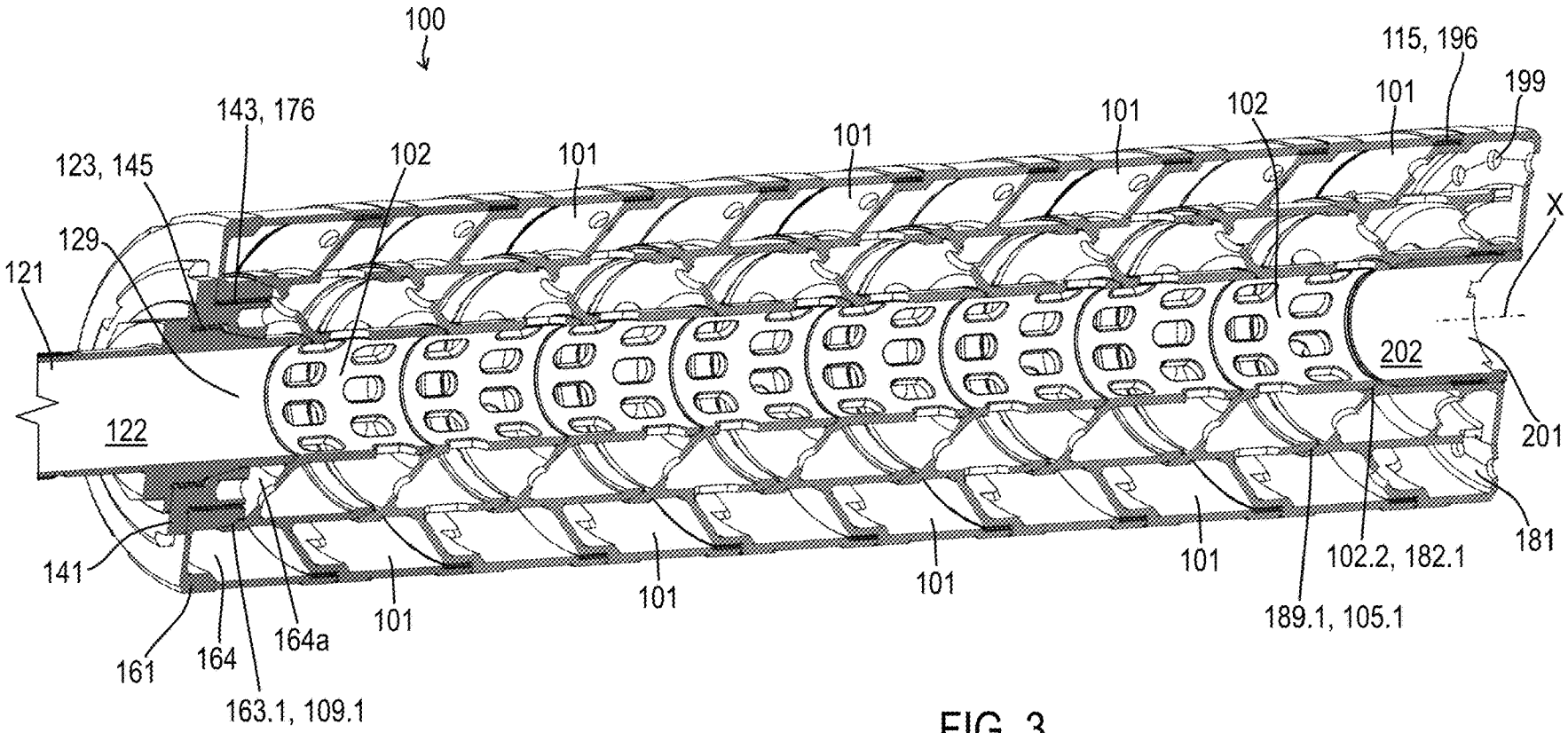
FIG. 3 is a cross-section view of the firearm suppressor assembly of FIG. 1.

In some cases, a firearm suppressor assembly 100 may include at least one baffle 101, a rear mount 121, a rear flange 141, a rear cap 161, a front cap 181, and/or a front insert 201 (see FIGS. 1-3). The suppressor assembly 100 may include a main body formed by the rear cap 161, one or more baffles 101, and the front cap 181. Although the drawings show the main body as cylindrical, the main body may have any appropriate shape or cross-section including rectangular, oval, triangular, square, polygonal, teardrop, elliptical, stadium (capsule), and/or any other appropriate shape. The bore axis X of the suppressor assembly 100 is shown in FIGS. 1-3. In some embodiments, the bore axis X is colinear with a bore axis of the firearm when the suppressor assembly 100 is installed on the firearm. In some embodiments, the components of the suppressor assembly 100 are designed to be created using additive manufacturing. For example, some components may be made using direct metal laser sintering, selective laser melting, electron beam melting, powder bed fusion, directed energy deposition, metal filament extrusion, metal material extrusion, binder jetting, and/or any other appropriate method.

The suppressor assembly 100 may include a plurality of baffles 101 including, as shown in FIG. 1, a configuration with eight baffles. In some embodiments, the suppressor assembly 100 includes one baffle 101. In other embodiments, the suppressor assembly 100 includes two baffles 101. In other embodiments, the suppressor assembly 100 includes three baffles 101. In other embodiments, the suppressor assembly 100 includes four baffles 101. In other embodiments, the suppressor assembly 100 includes five baffles 101. In other embodiments, the suppressor assembly 100 includes six baffles 101. In other embodiments, the suppressor assembly 100 includes seven baffles 101. In other embodiments, the suppressor assembly 100 includes nine baffles 101. In other embodiments, the suppressor assembly 100 includes ten baffles 101.

As described in more detail below, the rear mount 121 may include a portion that attaches to the firearm and a portion that attaches to other components of the suppressor assembly 100. In some embodiments, the rear mount 121 attaches directly to the rear cap 161. In other embodiments, the rear mount 121 attaches to the rear flange 141 and the rear flange 141 attaches to the rear cap 161 and/or a baffle 101.

A shown in FIGS. 7A-7F, each baffle 101 may include an inner guide 102, an inner chamber 103, an outer chamber 104, a chamber shelf wall 105, an outer wall 106, an inner transverse wall 107, an outer transverse wall 108, a rear wall 109, at least one guide hole 110, at least one inner transverse hole 111, at least one shelf hole 112, at least one forward shelf hole 113, at least one outer transverse hole 114, an inner attachment interface 115, an outer attachment interface 116, at least one tool interface 117, and/or at least one inner protrusion 118.

Figure 7A:
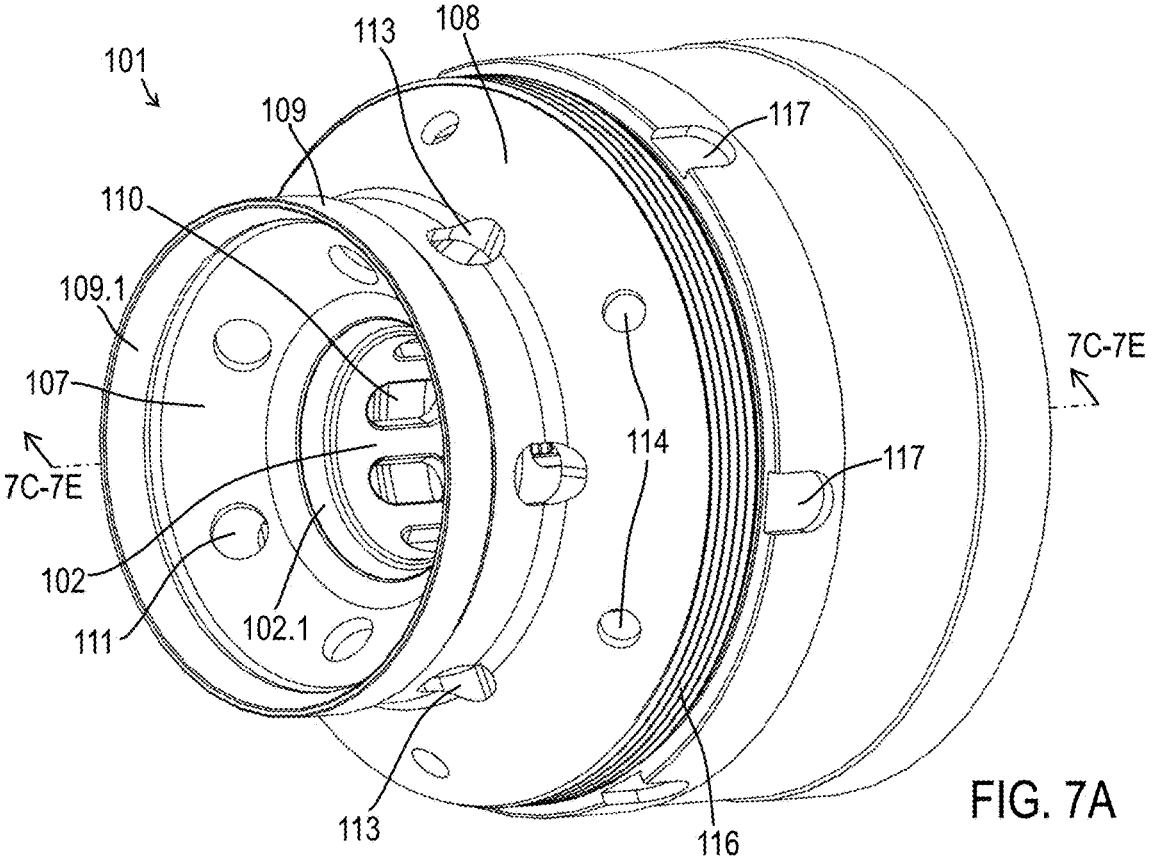
FIG. 7A is a rear perspective view of a baffle of the firearm suppressor assembly of FIG. 1.
Figure 7B:
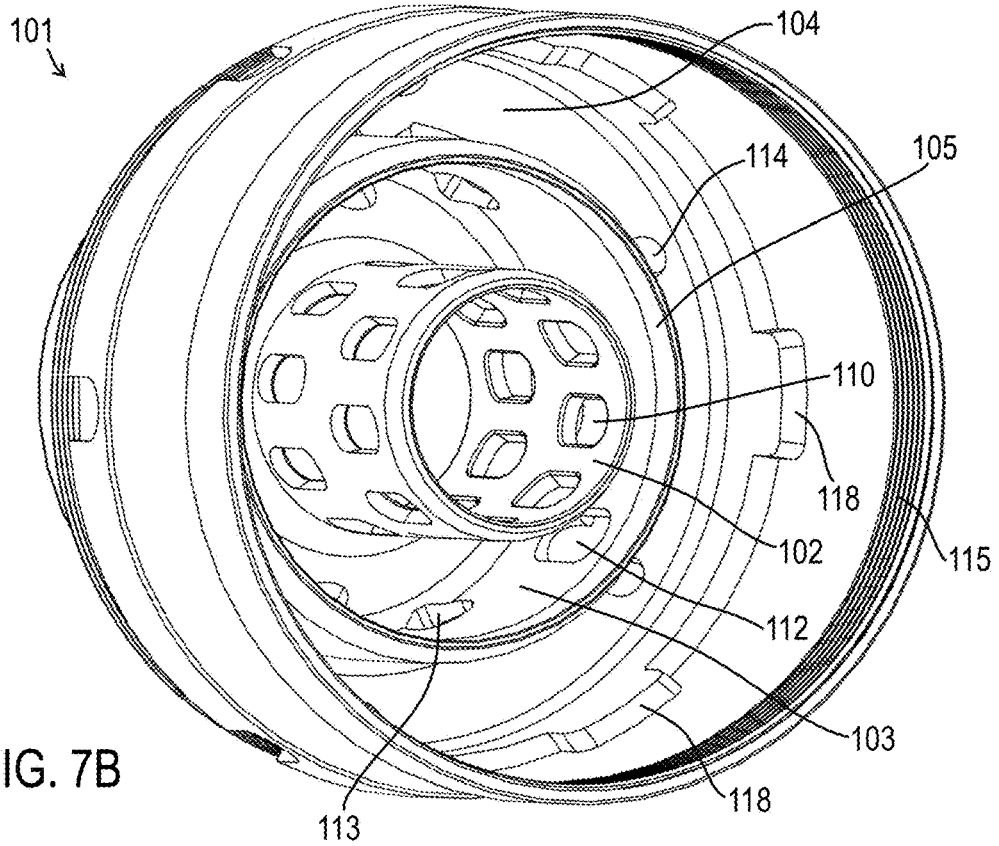
FIG. 7B is a front perspective view of the baffle of FIG. 7A.
Figure 7C:
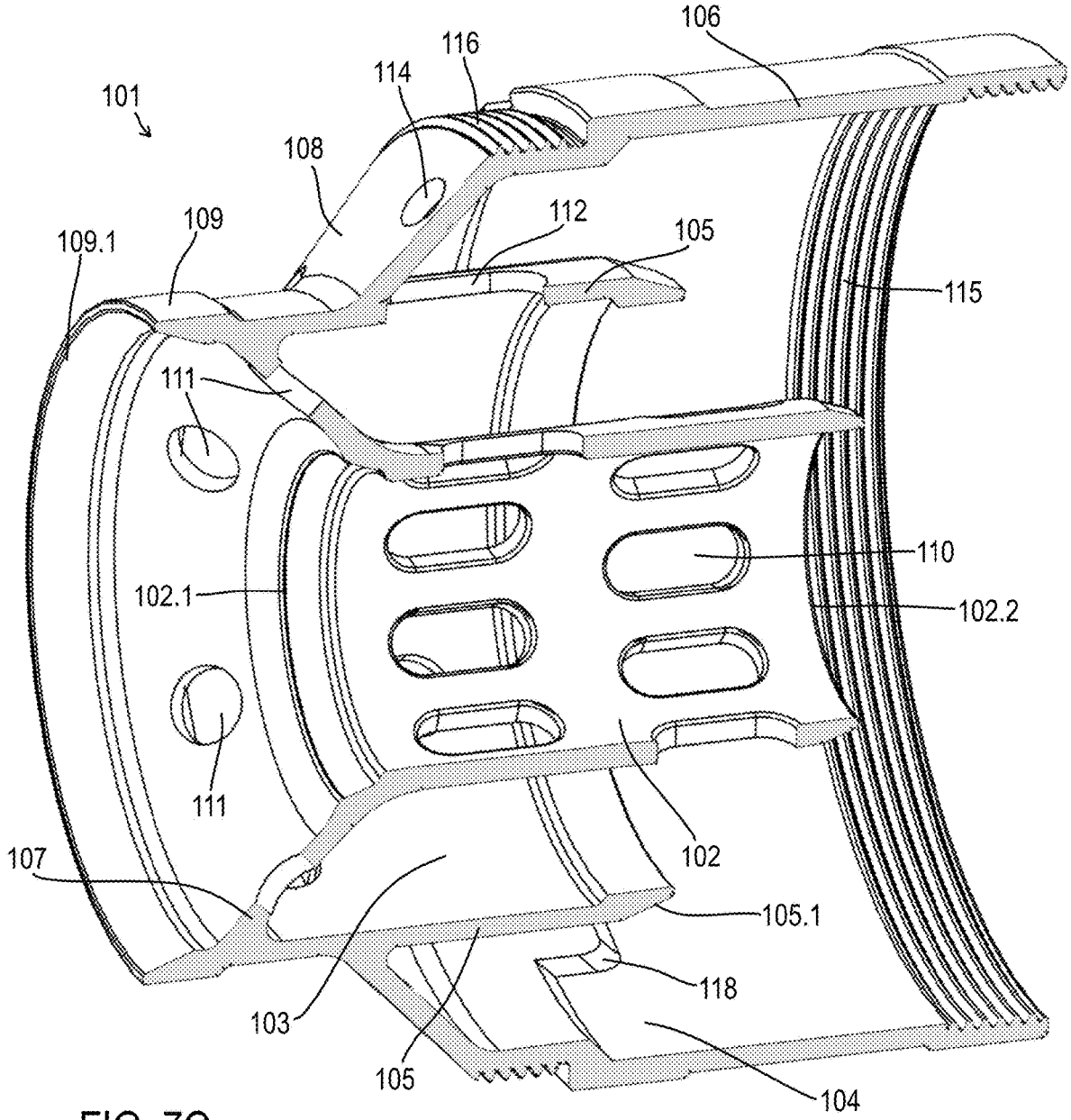
FIG. 7C is a cross-section view of the baffle of FIG. 7A.
Figure 7D:
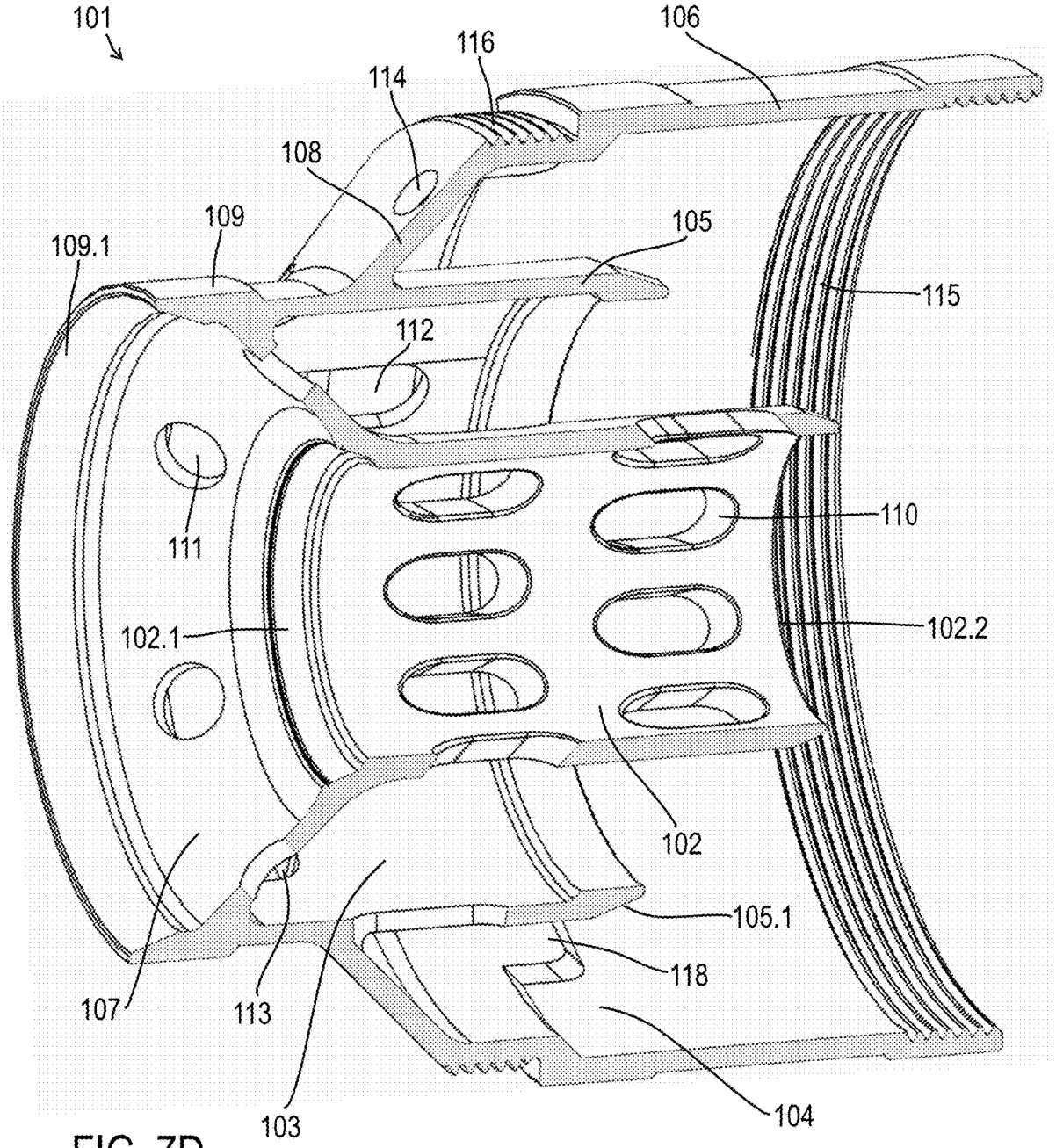
FIG. 7D is a cross-section view of the baffle of FIG. 7A.
Figure 7E:
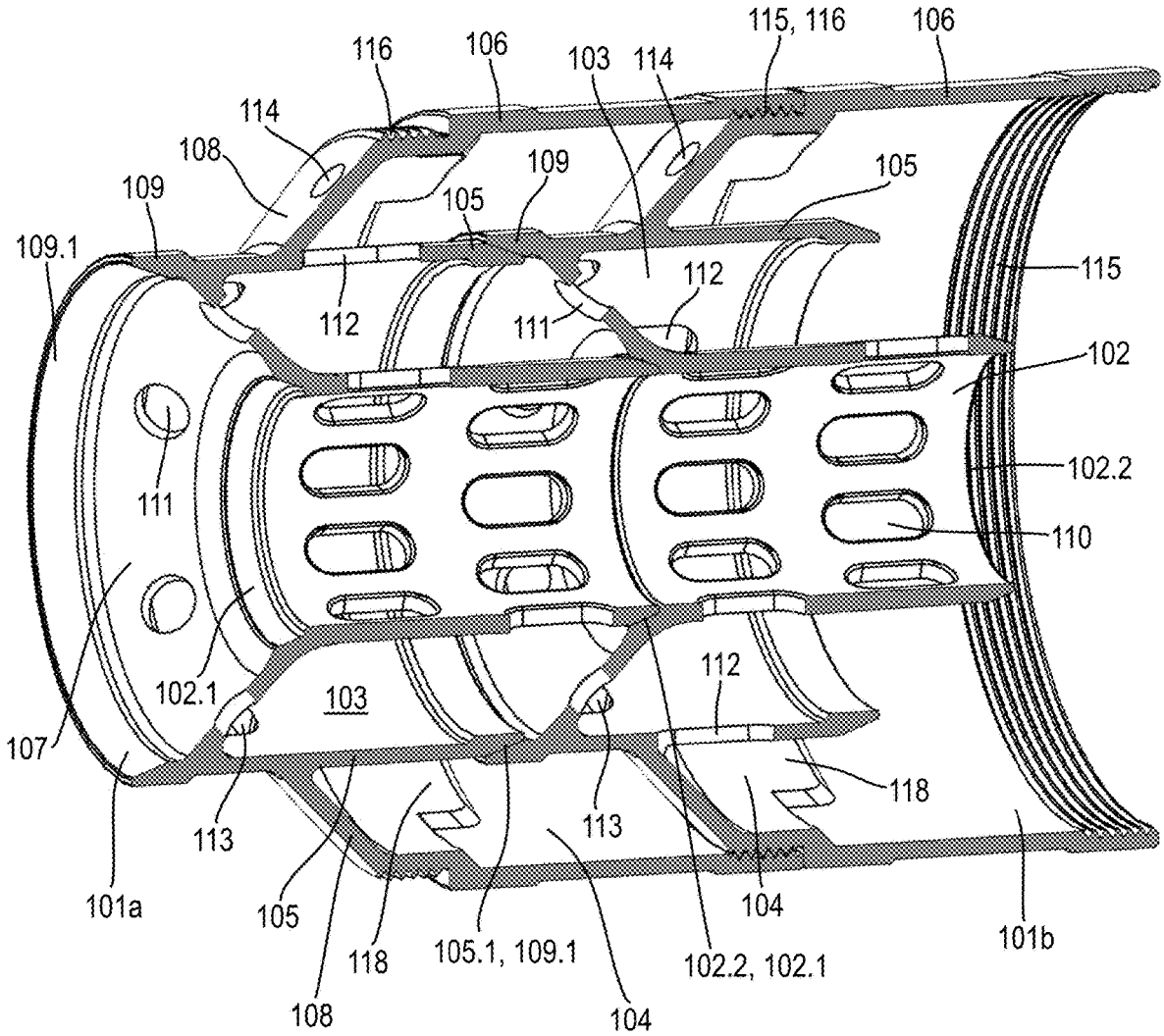
FIG. 7E is a cross-section view of two adjacent baffles of the firearm suppressor assembly of FIG. 1.
Figure 7F:
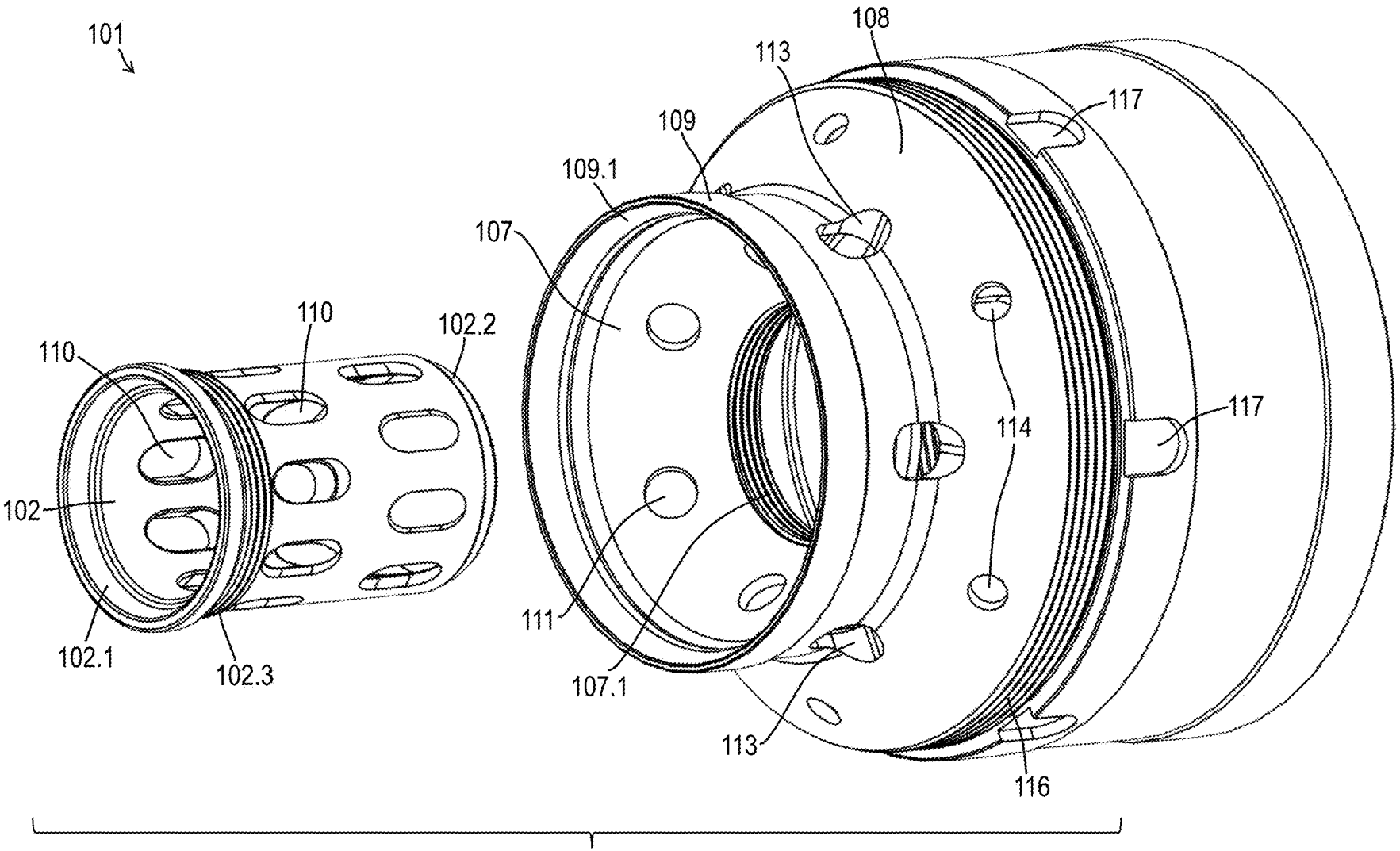
FIG. 7F is an exploded perspective view of a baffle assembly of the firearm suppressor assembly of FIG. 1.

In some embodiments, as shown in FIG. 7F, the baffle is a baffle assembly 101 that includes a separate inner guide 102. The separate inner guide 102 may include an attachment interface 102.3 that engages attachment interface 107.1 of the inner transverse wall 107. The connection between attachment interface 102.3 and attachment interface 107.1 may be a threaded connection (as illustrated in the drawings), a beveled surface, a notch, a recess, a tongue, a groove, a step, a latch, a press fit, a welded or sintered connection, and/or any other relevant feature. In some embodiments, the inner guide 102 is a separate component to make the parts more easily machinable for manufacturing (to reduce cost and time required for production).

The inner transverse wall 107 may be nonparallel with the adjacent walls (i.e., the rear wall 109 and the outer surface of the inner guide 102). In some embodiments, the inner transverse wall 107 is approximately 15°-75° relative to the rear wall 109. In other cases, the inner transverse wall 107 is approximately 30°-60° relative to the rear wall 109. In some cases, the inner transverse wall 107 is approximately 450 relative to the rear wall 109. In some cases, the inner transverse wall 107 is approximately 90° relative to the rear wall 109. The angle for the inner transverse wall 107 may be determined based on optimizing internal gas flow, manufacturing efficiency, and/or any other relevant criteria.

The outer transverse wall 108 may be nonparallel with the adjacent walls (i.e., the rear wall 109 and the outer wall 106). In some embodiments, the outer transverse wall 108 is approximately 15°-75° relative to the rear wall 109. In other cases, the outer transverse wall 108 is approximately 30°-60° relative to the rear wall 109. In some cases, the outer transverse wall 108 is approximately 450 relative to the rear wall 109. In some cases, the outer transverse wall 108 is approximately 90° relative to the rear wall 109. The angle for the outer transverse wall 108 may be determined based on optimizing internal gas flow, manufacturing efficiency, and/or any other relevant criteria.

The guide hole(s) 110 of the inner guide 102 may be arranged in radial pattern in one or more arrays around the surface of the inner guide 102. In some cases, the guide hole(s) 110 are arranged in two staggered arrays. Each guide hole 110 may be circular, rectangular, triangular, oval, square, polygonal, teardrop, elliptical, and/or any other appropriate shape. In some embodiments, as shown in the drawings, each guide hole 110 may be a shape having elongated sides with a semicircle at each end. This shape is sometimes referred to as a stadium shape or capsule shape. In some embodiments, the ratio of the length (between the semicircles) and the width (between the straight sides) is between 1.1 and 2.9. In other embodiments, the ratio of the length and the width is between 1.5 and 2.5. In some embodiments, the ratio of the length and the width is approximately 2. The inner guide 102 may have any number of guide hole(s) 110. In some embodiments, the inner guide 102 has 9 guide holes 110. In some embodiments, the inner guide 102 has 18 guide holes 110. In some embodiments, the inner guide 102 has 27 guide holes 110. In some embodiments, the inner guide 102 has 16 guide holes 110. In some embodiments, the inner guide 102 has 20 guide holes 110.

As shown in FIG. 7C, in some embodiments, each guide hole 110 may extend straight through the inner guide 102 such that each guide hole 110 is perpendicular to the local surface of the inner guide 102. In some embodiments, each guide hole 110 may extend at a non-90° angle through the inner guide 102 such that each guide hole 110 is oblique (i.e., not perpendicular or parallel) in at least one direction relative to the local surface of the inner guide 102. For example, the guide holes 110 illustrated in FIG. 7D are not perpendicular to the surface of the inner guide 102. The guide holes 110 in FIG. 7D are angled or tapered toward the rear of the baffle 101 (or baffle assembly 101). In some cases, the guide holes 110 are angled between 15° and 75° toward the rear of the baffle 101. In other cases, the guide holes 110 are angled between 30° and 60° toward the rear of the baffle 101. In some cases, the guide holes 110 are angled between 40° and 50° toward the rear of the baffle 101. In some cases, the guide holes 110 are angled approximately 45° toward the rear of the baffle 101. In other embodiments, the guide holes 110 are angled in other directions including forward, clockwise, counterclockwise, and/or any other direction (including compound directions). In some embodiments, there are a plurality of guide holes 110 that are arranged in multiple different directions such that some of the guide holes 110 are angled toward the rear, some are angled toward the front, and/or others are angled in other different directions.

The inner transverse hole(s) 111 and the outer transverse hole(s) 114 may be circular holes, as shown in the drawings. In some embodiments, the hole shape for the inner transverse hole(s) 111 and the outer transverse hole(s) 114 are rectangular, triangular, oval, square, polygonal, teardrop, elliptical, stadium, and/or any other appropriate shape. In some cases, the inner transverse hole(s) 111 are larger than the outer transverse hole(s) 114. The shelf hole(s) 112 may be stadium shape holes, as shown in the drawings. In some embodiments, the hole shape for the shelf hole(s) 112 are circular, rectangular, triangular, oval, square, polygonal, teardrop, elliptical, and/or any other appropriate shape. The hole shape for the forward shelf hole(s) 113 may be stadium, circular, rectangular, triangular, oval, square, polygonal, teardrop, elliptical, and/or any other appropriate shape. In some embodiments, the tool interface(s) 117 are designed for compatibility with a wrench or other tool to allow the operator to install, service, disassemble, and clean the suppressor assembly 100. In some cases, each inner protrusion 118 is designed to align with a corresponding tool interface 117 such that the inner protrusion 118 provides sufficient material and strength for the tool interface 117.

Figure 4A:
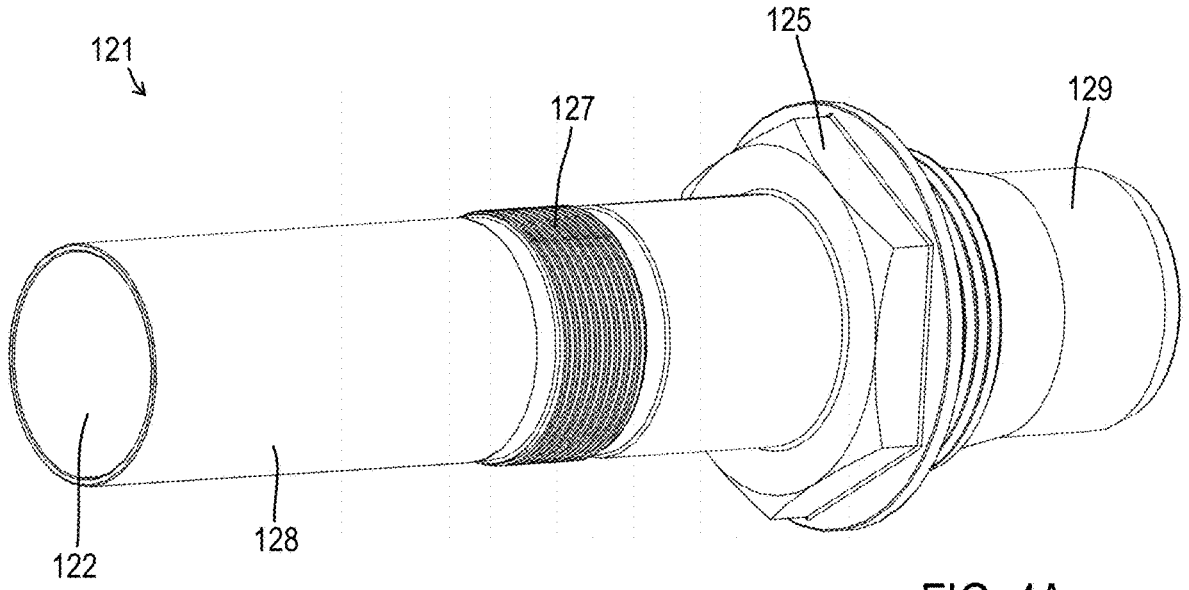
FIG. 4A is a rear perspective view of a rear mount of the firearm suppressor assembly of FIG. 1.
Figure 4B:
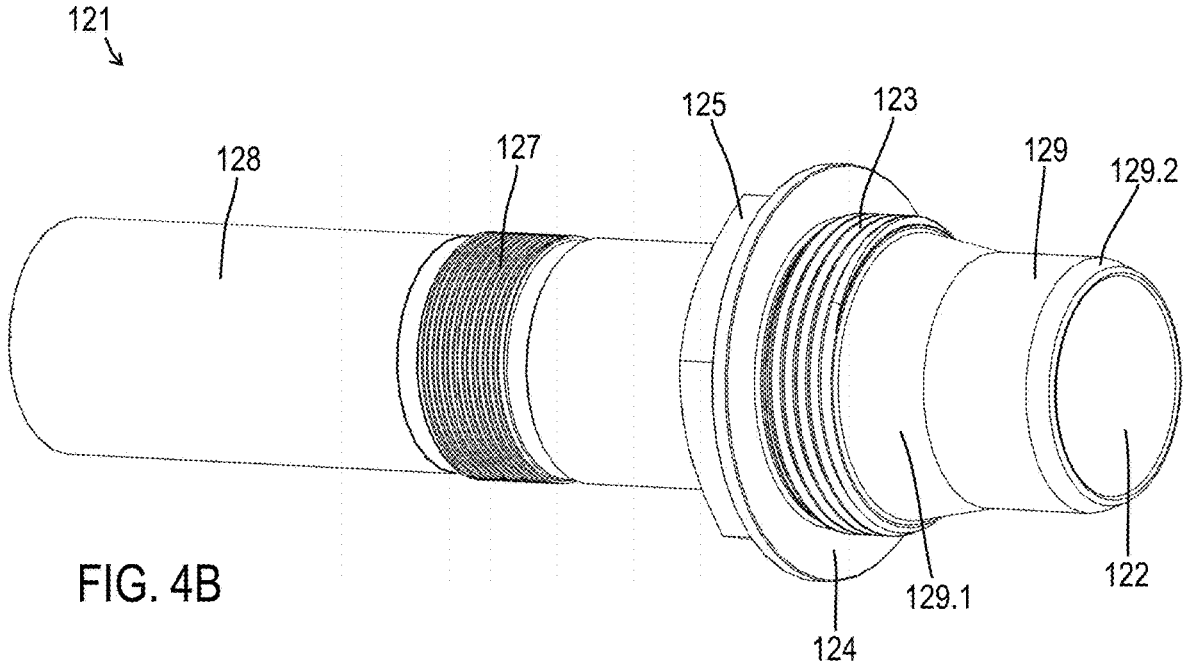
FIG. 4B is a front perspective view of the rear mount of FIG. 4A.
Figure 4C:
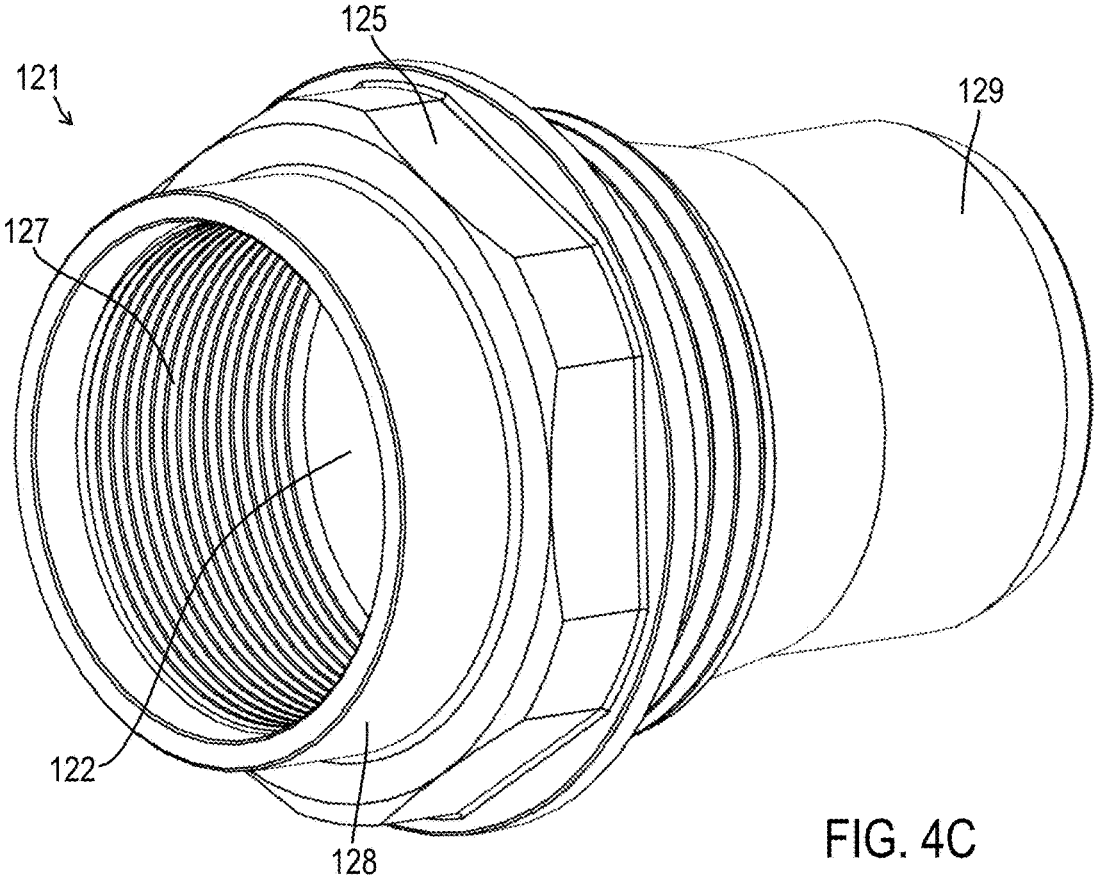
FIG. 4C is a rear perspective view of a rear mount of the firearm suppressor assembly of FIG. 1.
Figure 4D:
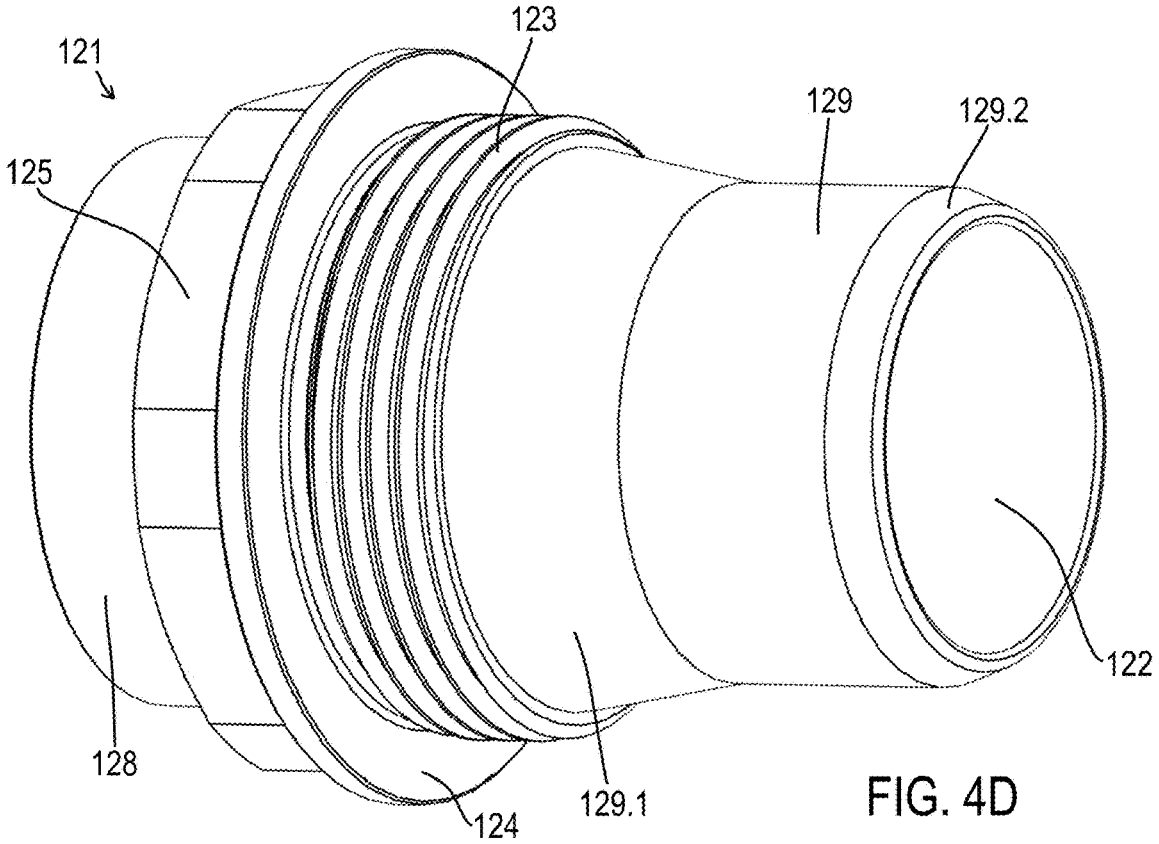
FIG. 4D is a front perspective view of the rear mount of FIG. 4C.

The rear mount 121 is shown in FIGS. 4A-4D. In some embodiments, the rear mount 121 includes an inner bore 122, a forward attachment interface 123, a rim 124, a tool interface 125, a rear attachment interface 127, a rear portion 128, and a forward portion 129. As shown in FIGS. 4A and 4B, the rear mount 121 may be designed with an extended rear portion 128 with an external rear attachment interface 127 designed to interface with a feature (e.g., threads) inside the barrel of a firearm. For example, the embodiment shown in FIGS. 4A and 4B may be designed for the rear attachment interface 127 to attach to a choke mount in a shotgun barrel. In other embodiments, as shown in FIGS. 4C and 4D, the rear mount 121 may be designed with a shorter rear portion 128 with an internal rear attachment interface 127 designed to interface with a feature (e.g., threads) on the exterior of the barrel of a firearm. For example, the embodiment shown in FIGS. 4C and 4D may be designed for the rear attachment interface 127 to attach to a threaded barrel for a rifle, a pistol, a shotgun, and/or a handgun.

Figure 5A:
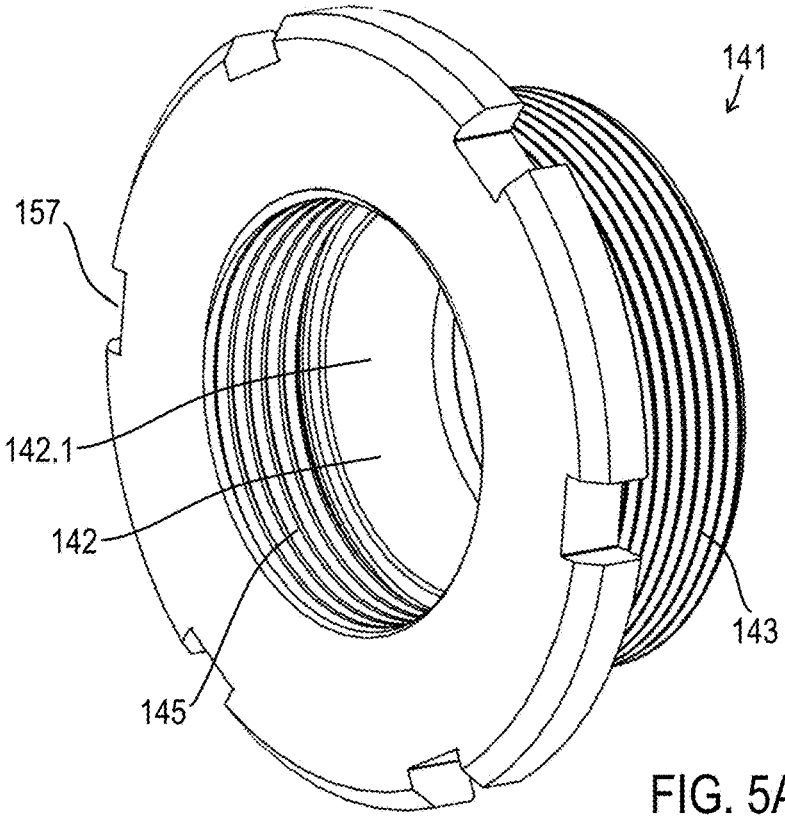
FIG. 5A is a rear perspective view of a rear flange of the firearm suppressor assembly of FIG. 1.
Figure 5B:
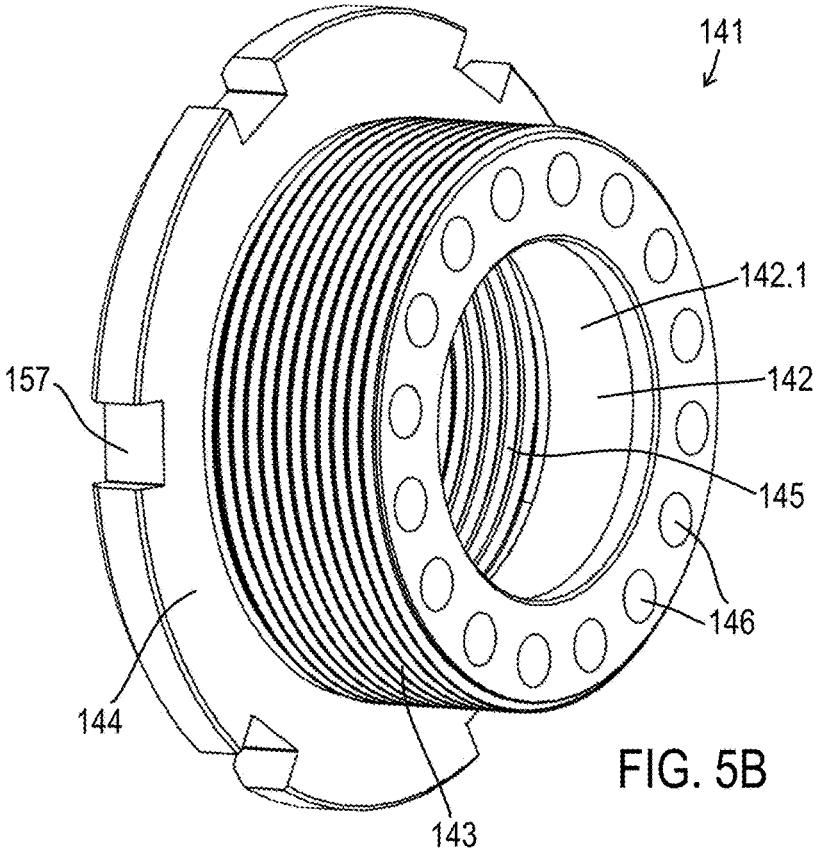
FIG. 5B is a front perspective view of the rear flange of FIG. 5A.

As shown in FIGS. 5A and 5B, the rear flange 141 may include an inner bore 142, an outer attachment interface 143, a rim 144, an inner attachment interface 145, at least one hole 146, and at least one tool interface 157. The hole(s) 146 may be designed to reduce material/weight of the rear flange 141, to create additional volume for propellant gases to expand, and/or for any other relevant reason.

Figure 6A:
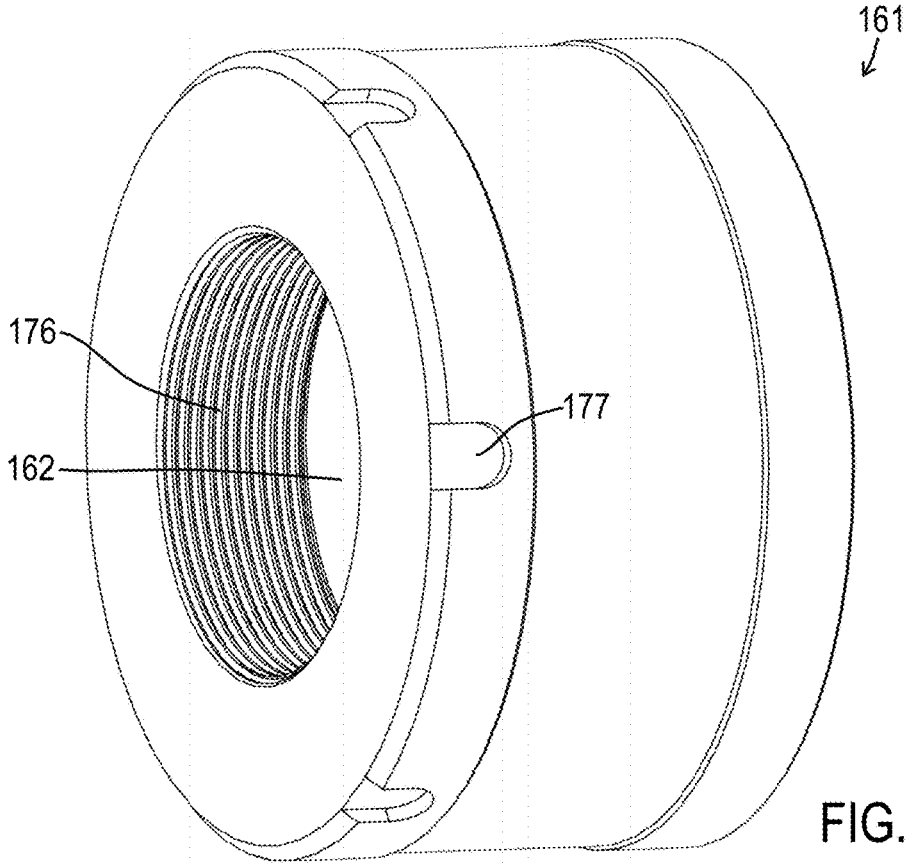
FIG. 6A is a rear perspective view of a rear cap of the firearm suppressor assembly of FIG. 1.
Figure 6B:
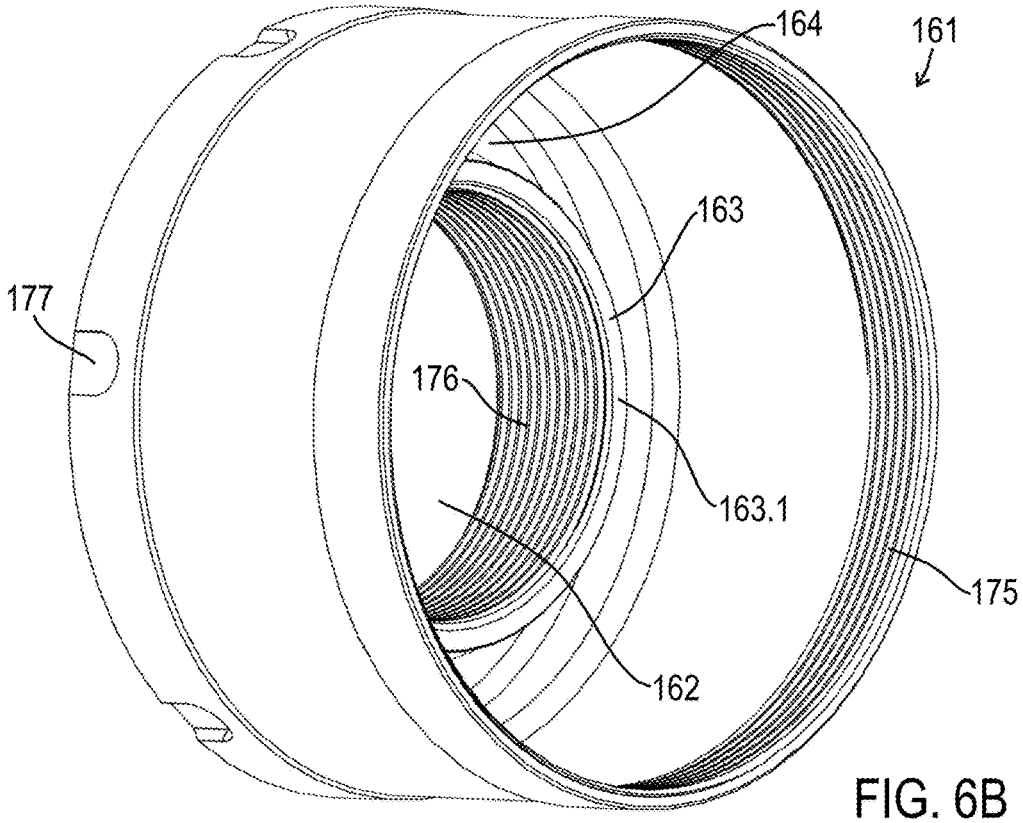
FIG. 6B is a front perspective view of the rear cap of FIG. 6A.

The rear cap 161 is illustrated in FIGS. 6A and 6B. In some embodiments, the rear cap 161 includes an inner bore 162, an inner flange 163, a chamber 164, a forward attachment interface 175, a rear attachment interface 176, and at least one tool interface 177.

As shown in FIGS. 8A-8D, the front cap 181 may include an inner bore 182, an inner chamber 183, an outer chamber 184, a chamber shelf wall 185, an outer wall 186, an inner transverse wall 187, an outer transverse wall 188, a rear wall 189, a secondary transverse wall 190, at least one inner transverse hole 191, at least one secondary transverse hole 190*a*, at least one shelf hole 192, at least one forward shelf hole 193, at least one outer transverse hole 194, an inner attachment interface 195, an outer attachment interface 196, at least one tool interface 197, an inner protrusion 198, and/or at least one exit hole 199.

Figure 8A:
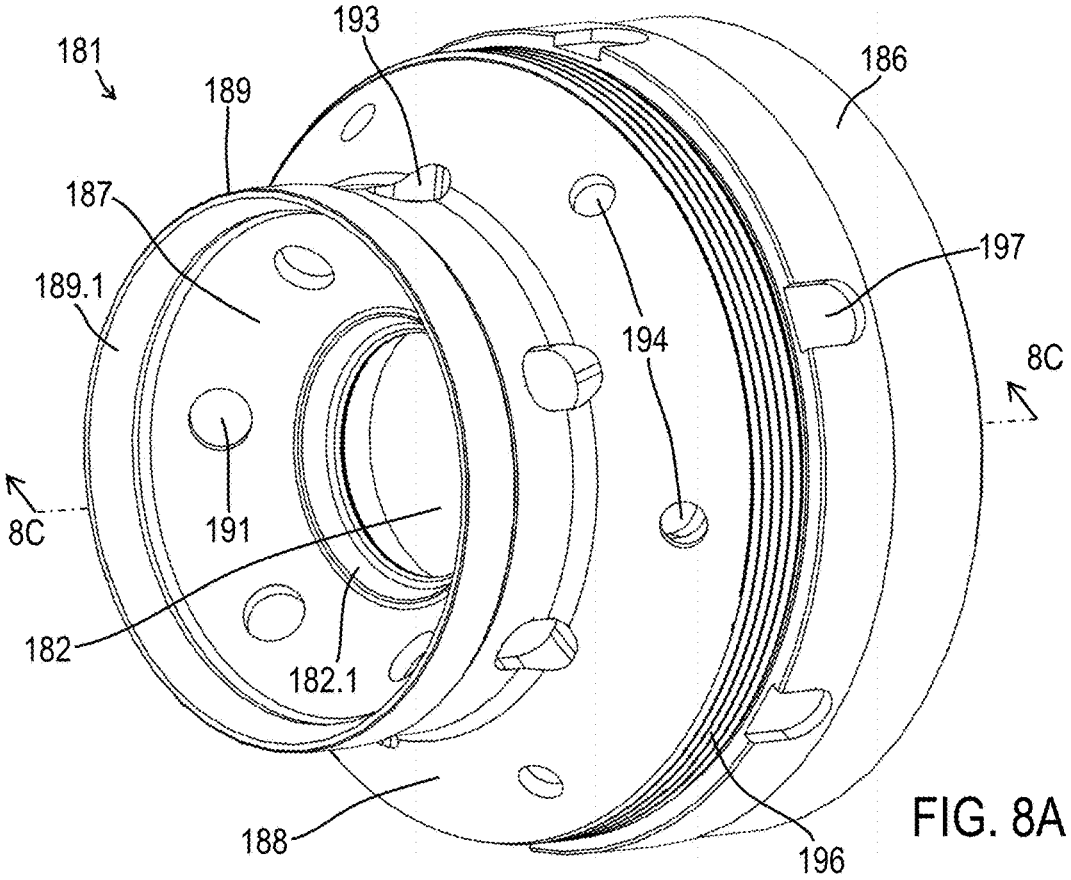
FIG. 8A is a rear perspective view of a front cap of the firearm suppressor assembly of FIG. 1.
Figure 8B:
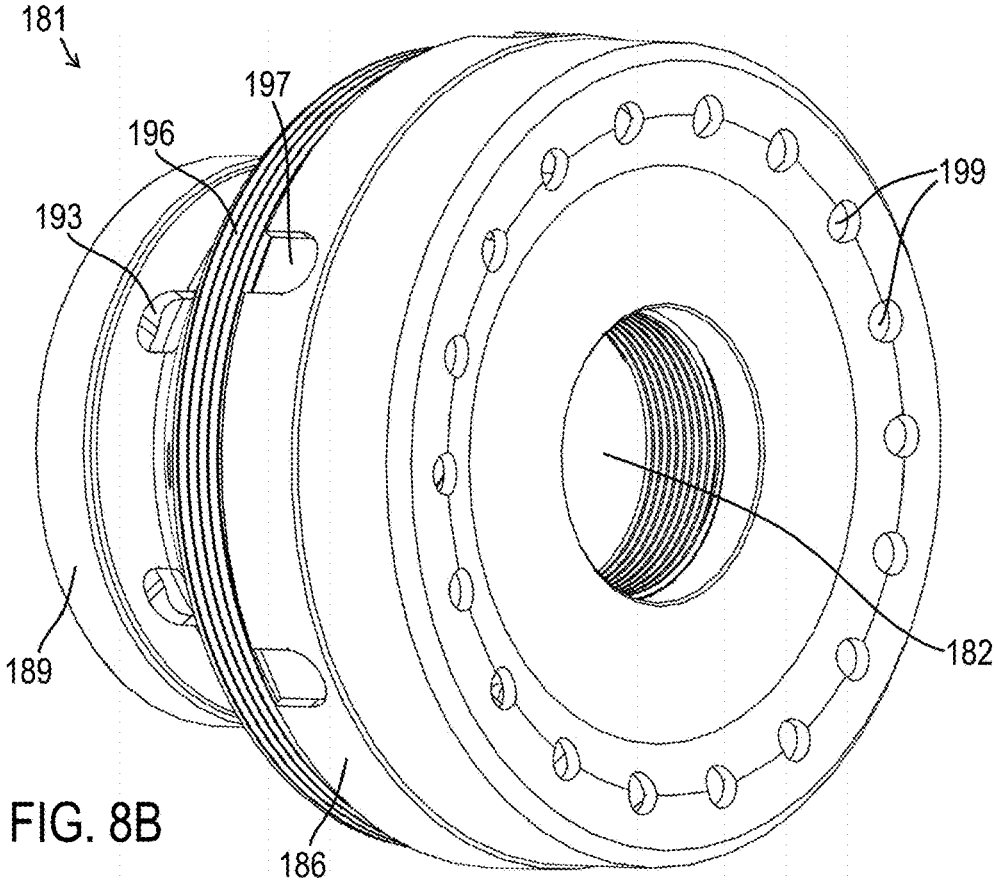
FIG. 8B is a front perspective view of the front cap of FIG. 8A.
Figure 8C:
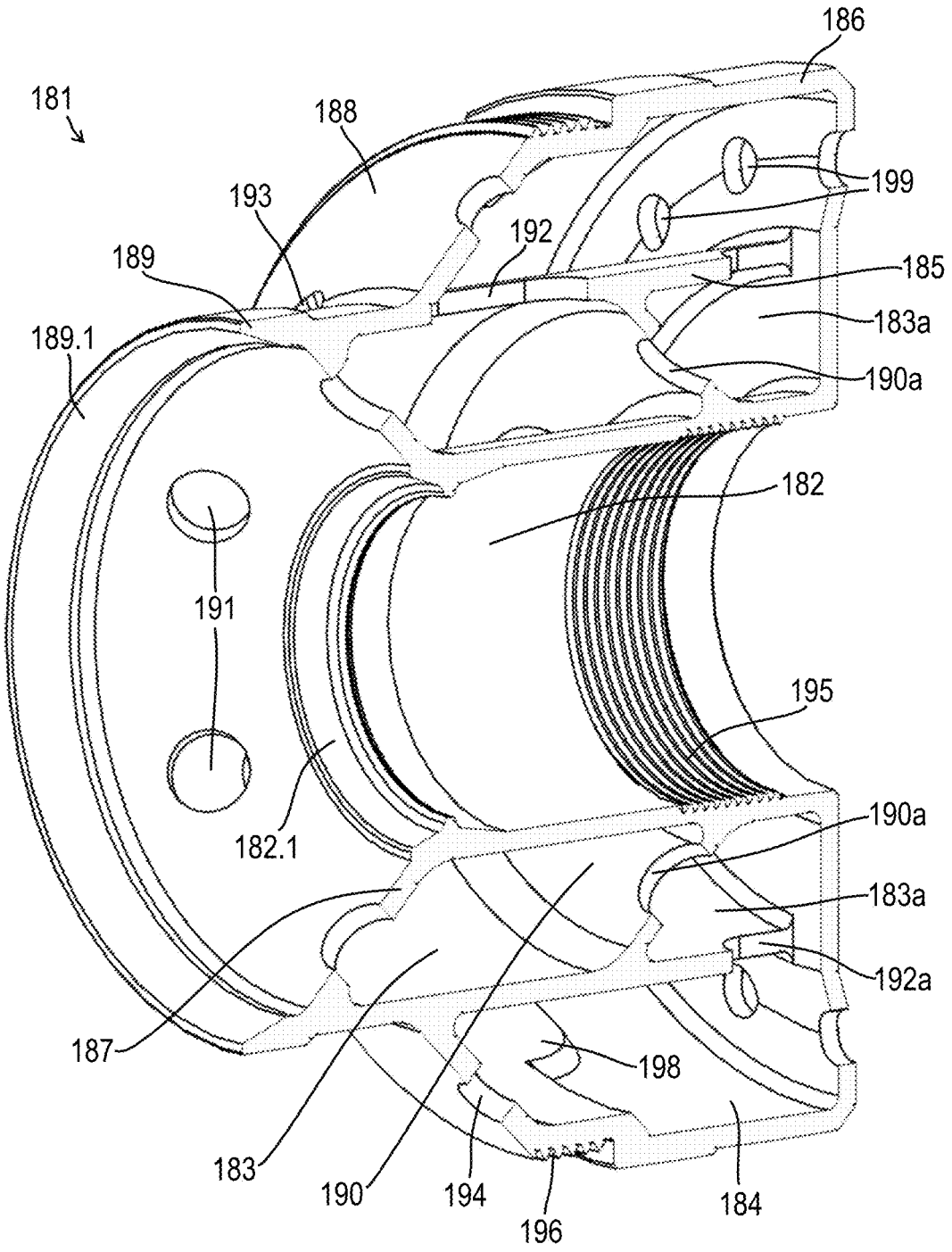
FIG. 8C is a cross-section view of the front cap of FIG. 8A.
Figure 8D:
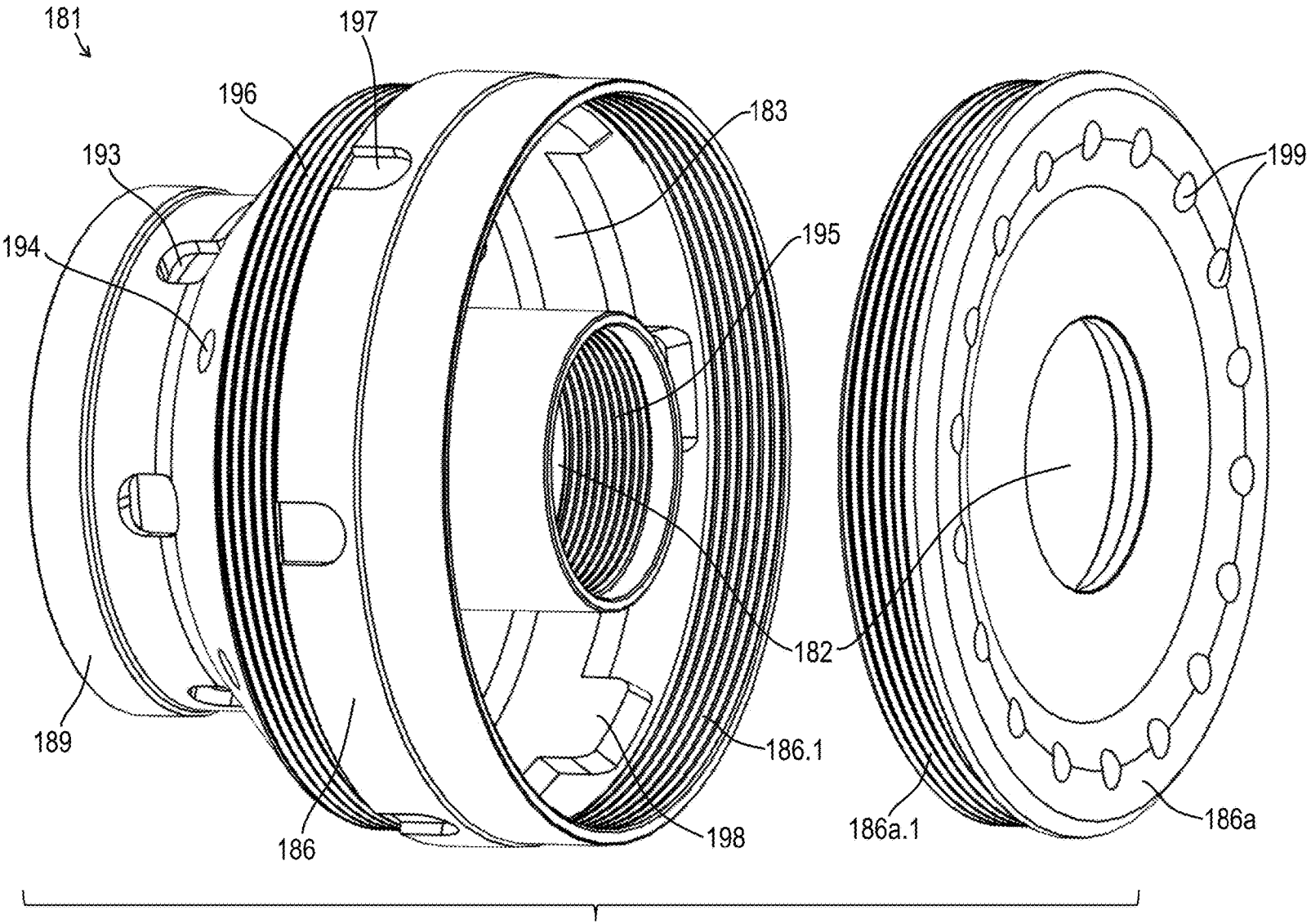
FIG. 8D is an exploded perspective view of a front cap assembly of the firearm suppressor assembly of FIG. 1.

In some embodiments, as shown in FIG. 8D, the front cap is a front cap assembly 181 that includes a separate front face 186*a*. The separate front face 186*a* may include an attachment interface 186*a*.1 that engages attachment interface 186.1 of the outer wall 186. The connection between attachment interface 186*a*.1 and attachment interface 186.1 may be a threaded connection (as illustrated in the drawings), a beveled surface, a notch, a recess, a tongue, a groove, a step, a latch, a press fit, a welded or sintered connection, and/or any other relevant feature. In some embodiments, the front face 186*a* is a separate component to make the parts more easily machinable for manufacturing (to reduce cost and time required for production). The front face 186*a* may also be designed as a separate modular component to allow the operator to swap to a different front face 186*a* with different exit hole(s) 199. For example, the operator may want to install a front face 186*a* that does not include any exit holes 199 (i.e., a fixed volume or sealed configuration). In other cases, the operator may install a front face 186*a* with large exit holes 199 (flow-through design) to ensure the semi-automatic operation of the firearm is not disrupted by the suppressor assembly 100. In other cases, the operator may install a front face 186*a* with fewer exit holes 199 such that none of these holes are located on a lower portion of the front face 186*a* causing gases exiting the front face 186*a* to disturb less dirt when the operator is in the prone position. In addition, the exit hole(s) 199 may be configured as threaded holes such that set screws can be added to one or more of the exit hole(s) 199 to change the flow of gases out of the suppressor assembly 100. This set screw configuration can be included whether the front face 186*a* is removable (see FIG. 8D) or the front cap is fixed as a part of the front cap 181 (see FIGS. 8A-8C). In some embodiments, the exit hole(s) 199 extend parallel to the bore axis X. In other embodiments, the exit hole(s) 199 extend in directions that are oblique relative to the bore axis X. In other words, the exit hole(s) 199 may be designed to expel gases in the direction that is not parallel to the bore axis X.

The inner transverse hole(s) 191 and the outer transverse hole(s) 194 may be circular holes, as shown in the drawings. In some embodiments, the hole shape for the inner transverse hole(s) 191 and the outer transverse hole(s) 194 are rectangular, triangular, oval, square, polygonal, teardrop, elliptical, stadium, and/or any other appropriate shape. The shelf hole(s) 192 may be stadium shape holes, as shown in the drawings. In some embodiments, the hole shape for the shelf hole(s) 192 are circular, rectangular, triangular, oval, square, polygonal, teardrop, elliptical, and/or any other appropriate shape. The hole shape for the forward shelf hole(s) 193 may be stadium, circular, rectangular, triangular, oval, square, polygonal, teardrop, elliptical, and/or any other appropriate shape. In some embodiments, the tool interface(s) 197 are designed for compatibility with a wrench or other tool to allow the operator to install, service, disassemble, and clean the suppressor assembly 100. In some cases, each inner protrusion 198 is designed to align with a corresponding tool interface 197 such that the inner protrusion 198 provides sufficient material and strength for the tool interface 197.

Figure 9:
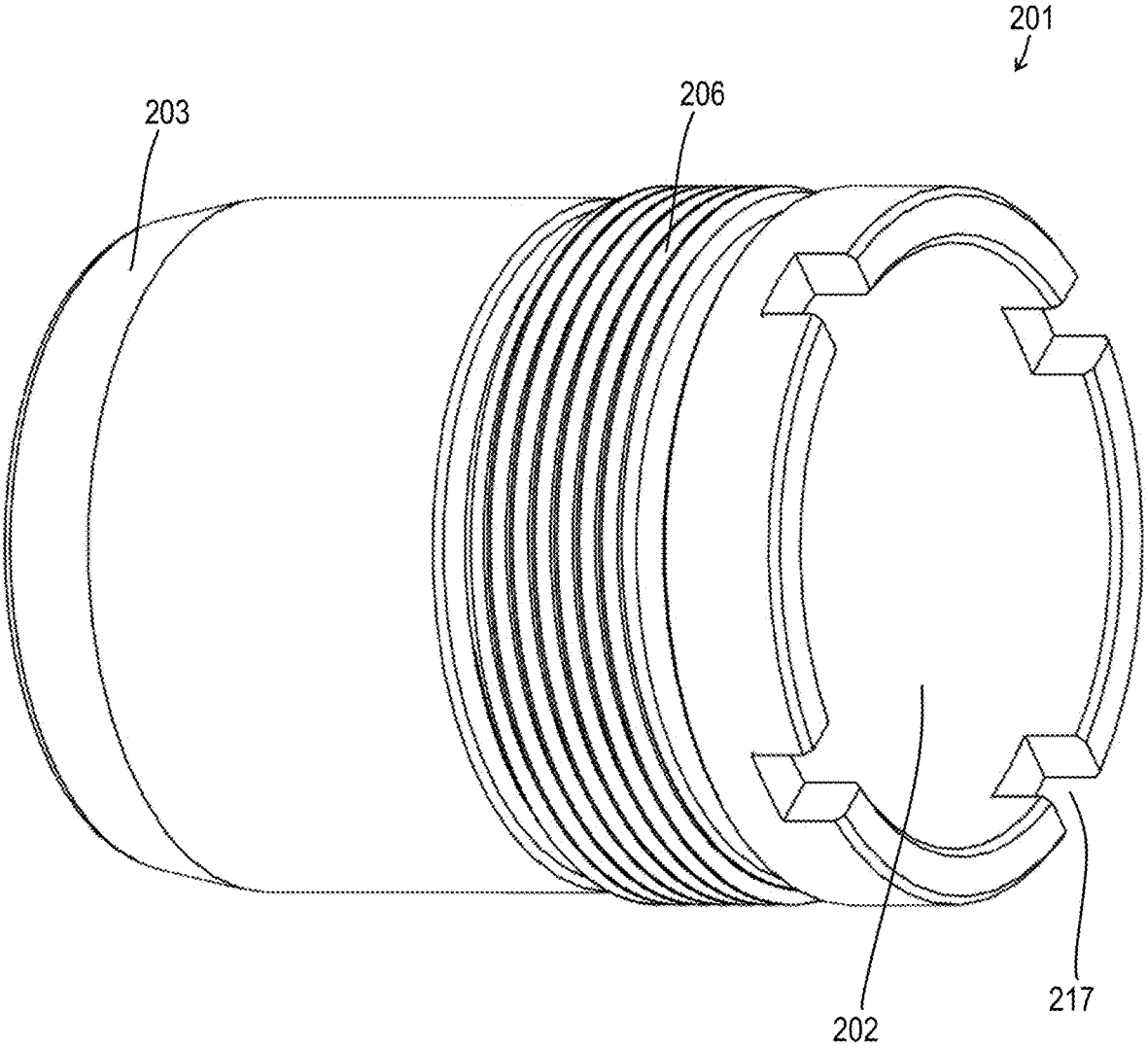
FIG. 9 is a front perspective view of a front insert of the firearm suppressor assembly of FIG. 1.

The front insert 201 is illustrated in FIG. 9. In some embodiments, the front insert 201 includes an inner bore 202, a rear edge 203, a rear attachment interface 206, and at least one tool interface 217.

FIGS. 1-3 show exemplary embodiments where the suppressor assembly 100 is assembled. In some embodiments, as shown in FIG. 3, the rear mount 121 includes (i) a forward edge 129.1 that interfaces with forward edge 142.1 of the inner bore 142 of the rear flange 141 and (ii) a forward portion 129 that extends through the rear cap 161 such that a forward edge 129.2 interfaces with the rear edge 102.1 of the inner guide 102 of the rearmost baffle 101 (closest to the rear cap 161). As shown in FIG. 7E, when a second baffle 101 is located on a forward side of a first baffle 101*a*, the forward edge 102.2 of the inner guide 102 of the first baffle 101*a* interfaces with the rear edge 102.1 of the inner guide 102 of the second baffle 101*b*. In some embodiments, the forward and rear edges of the inner guides 102 and/or the forward portion 129 include a mechanical feature designed to improve sealing between the adjacent components. The mechanical feature may include a beveled surface, a notch, a recess, a tongue, a groove, a step, and/or any other relevant feature.

As shown in FIG. 3, the rear cap 161 may include an inner flange 163 with a forward edge 163.1 that interfaces with a rear edge 109.1 of the rear wall 109 of the rearmost baffle 101 (closest to the rear cap 161). As shown in FIG. 7E, when a second baffle 101 is located on a forward side of a first baffle 101*a*, the forward edge 105.1 of the chamber shelf wall 105 of the first baffle 101*a* interfaces with the rear edge 109.1 of the rear wall 109 of the second baffle 101*b*. In some embodiments, the forward and rear edges of the inner flange 163, the chamber shelf wall 105, and/or the rear wall 109 include a mechanical feature designed to improve sealing between the adjacent components. The mechanical feature may include a beveled surface, a notch, a recess, a tongue, a groove, a step, and/or any other relevant feature.

As shown in FIG. 3, the front cap 181 may include a rear wall 189 with a rear edge 189.1 that interfaces with a forward edge 105.1 of the chamber shelf wall 105 of the forwardmost baffle 101 (closest to the front cap 181). In addition, the forward edge 102.2 of the inner guide 102 of the forwardmost baffle 101 may interface with the rear edge 182.1 of the inner bore 182 of the front cap 181 (see FIG. 3). In some embodiments, the forward and rear edges of the chamber shelf wall 105, the rear wall 189, the inner guide 102, and/or the inner bore 182 include a mechanical feature designed to improve sealing between the adjacent components. The mechanical feature may include a beveled surface, a notch, a recess, a tongue, a groove, a step, and/or any other relevant feature.

In addition to these sealing interfaces, the suppressor assembly 100 may include at least one attachment interface between the rear mount 121, the rear flange 141, the rear cap 161, the front cap 181, and/or the at least one baffle 101. For example, the rear mount 121 may include a forward attachment interface 123 that engages with an inner attachment interface 145 of the rear flange 141 (see FIG. 3). In some embodiments, the rear mount 121 includes a rear attachment interface 127 that engages a portion of the firearm. The rear flange 141 may include an outer attachment interface 143 that engages with a rear attachment interface 176 of the rear cap 161 (see FIG. 3). The rear cap 161 may include a forward attachment interface 175 that engages with an outer attachment interface 116 of the rearmost baffle 101 (closest to the rear cap 161). As shown in FIG. 7E, when a second baffle 101 is located on a forward side of a first baffle 101*a*, the inner attachment interface 115 of the first baffle 101*a* interfaces with the outer attachment interface 116 of the second baffle 101*b*. As shown in FIG. 3, the inner attachment interface 115 of the forwardmost baffle 101 may engage with an outer attachment interface 196 of the front cap 181. The front cap 181 may also include an inner attachment interface 195 that engages an outer attachment interface 206 of the front insert 201. In some embodiments, one or all of the attachment interfaces 115, 116, 123, 127, 143, 145, 175, 176, 195, 196, 206 are a threaded connection (as illustrated in the drawings), a beveled surface, a notch, a recess, a tongue, a groove, a step, a latch, a press fit, a welded or sintered connection, and/or any other relevant feature. In some embodiments, one or more of the attachment interfaces 115, 116, 123, 127, 143, 145, 175, 176, 195, 196, 206 are a left-hand threaded connection.

When the suppressor assembly 100 is attached to a firearm, a projectile or projectiles exit the firearm and immediately enter the inner bore 122 of the rear mount 121 (see FIG. 3). The projectile(s) subsequently pass through the inner guide 102 of each baffle 101. As discussed above, this may include a single baffle 101 or a plurality of baffles 101. After exiting the last baffle 101, the projectile(s) may pass through the inner bore 182 of the front cap 181 or, as shown in FIG. 3, the inner bore 202 of the front insert 201 extends within the front cap 181 such that there is little or no distance between the end of the final inner guide 102 and the inner bore 202. This path through the inner bore 122, the inner guide(s) 102, the inner bore 182, and/or the inner bore 202 may be designed to guide a wad from a shotgun shell.

The following describes some paths for gases flow through various portions of the suppressor assembly 100.

For each hole or connection described herein, it should be understood that gases can flow in the direction described and/or may flow in the reverse direction. When propellant gases exit the firearm and enter the suppressor assembly 100, the gases begin in the inner bore 122 of the rear mount 121 (see FIG. 3). The gases continue traveling until reaching the inner guide 102 of the rearmost baffle 101 (or baffle assembly 101). After reaching the inner guide 102, some of the gases will exit through the at least one guide hole 110 such that at least some of the gases enter the inner chamber 103. In some cases, there are four paths that gases can follow for exiting the inner chamber 103 (not including recirculating back through guide hole(s) 110). First, some of the gases may exit through the at least one shelf hole 112 such that at least some of the gases enter the outer chamber 104. Second, some of the gases may move rearward and exit through the at least one inner transverse hole 111 such that some of the gases, for the rearmost baffle 101 (or baffle assembly 101), enter the chamber 164*a* located on the forward side of the rear flange 141 (see FIG. 3). Some of these gases may enter the at least one hole 146. For a subsequent baffle 101 (or baffle assembly 101), gases that exit through the inner transverse hole(s) 111 would enter the inner chamber 103 of the baffle 101 (or baffle assembly 101) located forward (e.g., see inner transverse holes 111 of baffle 101*b* leading to the inner chamber 103 of baffle 101*a* in FIG. 7E). Third, some of the gases may exit through the at least one forward shelf hole 113 such that some of the gases, for the rearmost baffle 101 (or baffle assembly 101), enter the chamber 164 of the rear cap 161 (see FIG. 3). For a subsequent baffle 101 (or baffle assembly 101), gases that exit through the forward shelf hole(s) 113 would enter the outer chamber 104 of the baffle 101 (or baffle assembly 101) located forward (e.g., see forward shelf hole(s) 113 of baffle 101*b* leading to the outer chamber 104 of baffle 101*a* in FIG. 7E). Fourth, some of the gases may move forward and exit through the at least one inner transverse hole 111 of the subsequent baffle 101 (or baffle assembly 101) such that some of the gases enter the inner chamber 103 of the subsequent baffle 101 (or baffle assembly 101) located forward (e.g., see inner transverse holes 111 of baffle 101*b*, which connect the inner chamber 103 of baffle 101*a* with the inner chamber 103 of baffle 101*b* in FIG. 7E). For the forwardmost baffle 101 (or baffle assembly 101), some of the gases that travel forward would enter the inner transverse hole(s) 191 and enter the inner chamber 183 of the front cap 181 (or front cap assembly 181) (see FIGS. 8A-8D).

For gases that reach the outer chamber 104 (see first and third paths for exiting the inner chamber 103 above), in some cases, there are three paths that gases can follow for exiting the outer chamber 104 (not including recirculating back through shelf hole(s) 112 into the inner chamber 103). First, some of the gases may move rearward and exit through the outer transverse hole(s) 114 such that some of the gases, for the rearmost baffle 101 (or baffle assembly 101), enter the chamber 164 of the rear cap 161 (see FIG. 3). For a subsequent baffle 101 (or baffle assembly 101), gases that move rearward to exit through the outer transverse hole(s) 114 would enter the outer chamber 104 of the baffle 101 (or baffle assembly 101) located rearward (e.g., see outer transverse holes 114 of baffle 101*b* leading to the outer chamber 104 of baffle 101*a* in FIG. 7E). Second, some of the gases may exit through the at least one forward shelf hole 113 of the subsequent baffle 101 (or baffle assembly 101) located forward such that some of the gases enter the inner chamber 103 of the subsequent baffle 101 (or baffle assembly 101). For the forwardmost baffle 101 (or baffle assembly 101), some of the gases that travel forward enter the at least one forward shelf hole 193 of the front cap 181 (or front cap assembly 181) such that some of the gases enter the inner chamber 183 of the front cap 181 (or front cap assembly 181) (see FIGS. 8A-8D). Third, some of the gases may move forward and exit through the outer transverse hole(s) 114 of the subsequent baffle 101 (or baffle assembly 101) such that some of the gases enter the outer chamber 104 of the subsequent baffle 101 (or baffle assembly 101) located forward (e.g., see outer transverse hole(s) 114 of baffle 101*b*, which connect the outer chamber 104 of baffle 101*a* with the outer chamber 104 of baffle 101*b* in FIG. 7E). For the forwardmost baffle 101 (or baffle assembly 101), some of the gases that travel forward enter the at least one outer transverse hole 194 of the front cap 181 (or front cap assembly 181) such that some of the gases enter the outer chamber 184 of the front cap 181 (see FIGS. 8A-8C) or the inner chamber 183 of the front cap assembly 181 (see FIG. 8D).

Some gases reach the front cap 181 (or front cap assembly 181) (see fourth path for exiting the inner chamber 103 and the second/third paths for exiting the outer chamber 104 above). As shown in FIG. 8C, some of the gases that reach the inner chamber 183 will enter the at least one secondary transverse hole 190*a* such that some of the gases enter the forward inner chamber 183*a*. In addition, some of the gas will enter the at least one shelf hole 192 such that some of the gases enter the outer chamber 184. It should be noted that some of the gas that reaches the forward inner chamber 183*a* will also enter the outer chamber 184 through the at least one forward shelf hole 192*a*. The outer chamber 184 is the final location that gases reach in the suppressor assembly 100 such that gases (i) may reverse and flow through one or more of the chambers described above, (ii) may remain in outer chamber 184, or (iii) may exit the suppressor assembly 100 through the exit hole(s) 199. In some embodiments, as shown in FIG. 8D, the front cap assembly 181 does not include the chamber shelf wall 185, the secondary transverse wall 190, the forward inner chamber 183*a*, and the outer chamber 184. For the front cap assembly 181, all gases that enter will expand into a single chamber 183 such that the gases (i) may reverse and flow through one or more of the chambers described above, (ii) may remain in the chamber 183, or (iii) may exit the suppressor assembly 100 through the exit hole(s) 199.

The components of any of the suppressor assemblies 100 described herein may be formed of materials including, but not limited to, thermoplastic, carbon composite, plastic, nylon, glass-filled nylon, steel, aluminum, stainless steel, high strength aluminum alloy, titanium, other plastic or polymer materials, other metallic materials, other composite materials, or other similar materials. Moreover, the components of the firearms may be attached to one another via suitable fasteners, which include, but are not limited to, screws, bolts, rivets, welds, co-molding, injection molding, or other mechanical or chemical fasteners.

Different arrangements of the components depicted in the drawings or described above, as well as components and steps not shown or described are possible. Similarly, some features and sub-combinations are useful and may be employed without reference to other features and sub-combinations. Embodiments of the invention have been described for illustrative and not restrictive purposes, and alternative embodiments will become apparent to readers of this patent. Accordingly, the present invention is not limited to the embodiments described above or depicted in the drawings, and various embodiments and modifications may be made without departing from the scope of the claims below.

That which is claimed is:

1. A suppressor assembly for a firearm, the suppressor assembly comprising:

a rear mount comprising an inner bore, a rear attachment interface, and a forward attachment interface;

a rear cap attached to the rear mount through the forward attachment interface;

at least one baffle on a forward side of the rear cap; and a front cap on a forward side of the at least one baffle, wherein:

the rear attachment interface is configured to connect the suppressor assembly to the firearm;

the at least one baffle comprises an inner guide forming a cylindrical cavity, an inner chamber disposed outboard of the inner guide and separated from the cylindrical cavity by a first wall of the inner guide, and an outer chamber disposed outboard of the inner chamber and separated from the inner chamber by a chamber shelf wall; and a second baffle on the forward side of the at least one baffle comprises a first forward wall to enclose the inner chamber and a second forward wall to enclose the outer chamber, the first forward wall and the second forward wall extending in a direction which is oblique relative to a bore axis of the suppressor assembly.

2. The suppressor assembly of claim 1, wherein the firearm comprises a shotgun.

3. The suppressor assembly of claim 1, wherein the rear cap is directly attached to the rear mount at the forward attachment interface.

4. The suppressor assembly of claim 1, further comprising a rear flange, the rear flange comprising:

an inner attachment interface that engages the forward attachment interface of the rear mount; and an outer attachment interface that engages the rear cap.

5. The suppressor assembly of claim 1, wherein the at least one baffle comprises at least six baffles.

6. The suppressor assembly of claim 1, wherein the front cap comprises a plurality of exit holes that allow propellant gases to exit the suppressor assembly through the front cap and at least one of the plurality of exit holes extends in a direction that is parallel to the bore axis of the suppressor assembly.

7. The suppressor assembly of claim 1, wherein the outer chamber comprises an outer transverse hole that is radially spaced between the chamber shelf wall and an outer wall of the baffle.

8. The suppressor assembly of claim 1, wherein:

the first wall of the inner guide comprises a plurality of guide holes; and at least one of the plurality of guide holes extends in a direction that is oblique relative to a surface of the inner guide.

9. The suppressor assembly of claim 1, wherein the chamber shelf wall comprises at least one shelf hole.

10. The suppressor assembly of claim 1, wherein:

the chamber shelf wall comprises an annular shape extending in a direction that is parallel to the bore axis of the suppressor assembly; and the chamber shelf wall comprises a plurality of holes extending through the chamber shelf wall.

11. A suppressor assembly for a shotgun, the suppressor assembly comprising:

a rear mount comprising an inner bore, a rear attachment interface, and a forward attachment interface;

a main body attached to the forward attachment interface;

a first baffle disposed forward of the rear mount; and a front cap on a forward side of the first baffle, wherein:

the rear attachment interface is configured to connect the suppressor assembly to the shotgun;

the first baffle comprises an inner guide forming a cylindrical cavity, an inner chamber disposed outboard of the inner guide and separated from the cylindrical cavity by a first wall of the inner guide, and an outer chamber disposed outboard of the inner chamber and separated from the inner chamber by a chamber shelf wall;

the outer chamber comprises an outer transverse hole that is radially spaced between the chamber shelf wall and an outer wall of the first baffle;

a second baffle on the forward side of the first baffle comprises a first forward wall to enclose the inner chamber and a second forward wall to enclose the outer chamber, the first forward wall and the second forward wall extending in a direction which is oblique relative to a bore axis of the suppressor assembly; and the main body is cylindrical.

12. The suppressor assembly of claim 11, wherein the main body comprises:

a rear cap attached to the rear mount through the forward attachment interface;

wherein the front cap is disposed on the forward side of the first baffle.

13. The suppressor assembly of claim 11, wherein the inner guide is removably attached to the inner chamber of the first baffle.

14. The suppressor assembly of claim 11, wherein:

the chamber shelf wall comprises an annular shape extending in a direction that is parallel to the bore axis of the suppressor assembly; and the chamber shelf wall comprises a plurality of holes extending through the chamber shelf wall.

15. The suppressor assembly of claim 11, wherein the front cap comprises a plurality of exit holes that allow propellant gases to exit the suppressor assembly through the front cap and at least one of the plurality of exit holes extends in a direction that is parallel to the bore axis of the suppressor assembly.

16. The suppressor assembly of claim 11, wherein the inner chamber has approximately the same cross-sectional area as the outer chamber.

17. The suppressor assembly of claim 11, wherein:

the first wall of the inner guide comprises at least fourteen guide holes; and at least one of the guide holes extends in a direction that is oblique relative to a surface of the inner guide.

18. The suppressor assembly of claim 11, wherein the first forward wall comprises at least one inner transverse hole and the second forward wall comprises the outer transverse hole.

* * * * *